US009089955B2

(12) United States Patent
Johnson

(10) Patent No.: US 9,089,955 B2
(45) Date of Patent: Jul. 28, 2015

(54) LOCKING MECHANISM AND TOOL DEVICE

(71) Applicant: Robyn Marie Johnson, Milford, CT (US)

(72) Inventor: Robyn Marie Johnson, Milford, CT (US)

(73) Assignee: Baseline Redefined, LLC, Milford, CT (US)

( * ) Notice: Subject to any disclaimer, the term of this patent is extended or adjusted under 35 U.S.C. 154(b) by 68 days.

(21) Appl. No.: 13/773,775

(22) Filed: Feb. 22, 2013

(65) Prior Publication Data

US 2013/0160612 A1 Jun. 27, 2013

Related U.S. Application Data

(63) Continuation-in-part of application No. 12/796,262, filed on Jun. 8, 2010, now Pat. No. 8,430,003.

(60) Provisional application No. 61/268,135, filed on Jun. 9, 2009, provisional application No. 61/276,376, filed on Sep. 11, 2009, provisional application No. 61/342,375, filed on Apr. 12, 2010.

(51) Int. Cl.

| | |
|---|---|
| ***B25B 25/00*** | (2006.01) |
| ***B25B 23/00*** | (2006.01) |
| ***B25B 15/04*** | (2006.01) |
| ***B25F 5/02*** | (2006.01) |
| ***B25G 1/08*** | (2006.01) |

(52) U.S. Cl.

CPC ..... *B25B 23/0028* (2013.01); *B25B 15/04* (2013.01); *B25B 23/00* (2013.01); *B25F 5/029* (2013.01); *B25G 1/085* (2013.01)

(58) Field of Classification Search

CPC ..... B25B 15/02; B25B 15/04; B25B 15/008; B25B 13/56; B25B 23/0028; B25B 23/00; B25F 5/29; B25G 1/063; B25G 1/085; B25Q 13/00

USPC ..... 81/427.5, 438, 439, 440, 450, 177.4, 81/177.8, 177.9, 489; 7/165–168; 16/111.1, 430, 436, 438

See application file for complete search history.

(56) References Cited

U.S. PATENT DOCUMENTS

| | | | |
|---|---|---|---|
| 1,398,583 | A | 11/1921 | Bovee |
| 1,787,424 | A | 1/1931 | Altenbach |
| 2,804,970 | A | 9/1957 | Kuc et al. |
| 3,061,927 | A | 11/1962 | Von Frankenberg |
| 3,364,508 | A | 1/1968 | Garrett |
| 3,667,518 | A | 6/1972 | Stillwagon, Jr. |
| 4,261,103 | A | 4/1981 | Heck |

(Continued)

*Primary Examiner* — Robert Pezzuto

(74) *Attorney, Agent, or Firm* — McCarter & English, LLP

(57) ABSTRACT

Exemplary embodiments are directed to locking mechanisms situated within a cavity of a device defined by side walls located opposite and facing each other that generally include a linear slide fixed to at least one of the side walls. The exemplary locking mechanisms generally include a linear lock configured and dimensioned to at least partially receive and surround the linear slide within a linear lock core. The exemplary locking mechanisms generally further include at least one tool element. Exemplary embodiments are further directed to tool devices situated within a holding means that generally include first and second tool elements. The first and second tool elements are generally positioned in an adjacent arrangement and the first and second proximal end widths are generally dimensionally dissimilar. A dimensional relationship generally exists between the first and second proximal end widths and the first and second distal end widths.

20 Claims, 35 Drawing Sheets

(56) References Cited

U.S. PATENT DOCUMENTS

| | | | | |
|---|---|---|---|---|
| 4,384,499 | A | 5/1983 | Shockley | |
| 4,452,289 | A | 6/1984 | Smith | |
| 4,848,197 | A | 7/1989 | Kikel | |
| 4,983,080 | A | 1/1991 | Somers | |
| 5,062,173 | A | 11/1991 | Collins et al. | |
| 5,146,815 | A | 9/1992 | Scott, III | |
| 5,174,698 | A | 12/1992 | Obermeier | |
| 5,265,504 | A | 11/1993 | Fruhm | |
| 5,271,300 | A | 12/1993 | Zurbuchen et al. | |
| 5,320,004 | A | 6/1994 | Hsiao | |
| 5,346,453 | A | 9/1994 | Rivera | |
| 5,450,774 | A | 9/1995 | Chang | |
| 5,522,291 | A | 6/1996 | Liv | |
| 5,562,208 | A | 10/1996 | Hasler | |
| 5,581,834 | A | 12/1996 | Collins | |
| 5,592,859 | A | 1/1997 | Johnson et al. | |
| 5,613,413 | A | 3/1997 | Huang | |
| 5,641,066 | A | 6/1997 | Maslaro | |
| 5,669,492 | A | 9/1997 | Chao | |
| D385,172 | S | 10/1997 | Bramsiepe et al. | |
| 5,711,042 | A | 1/1998 | Chuang | |
| 5,711,194 | A | 1/1998 | Anderson et al. | |
| 5,740,706 | A | 4/1998 | Tseng | |
| 5,765,454 | A | 6/1998 | Barbulescu | |
| 5,791,211 | A | 8/1998 | Bondhus et al. | |
| 5,802,936 | A * | 9/1998 | Liu | 81/450 |
| 5,819,612 | A | 10/1998 | Anderson et al. | |
| 5,881,615 | A | 3/1999 | Dahl et al. | |
| 5,896,606 | A | 4/1999 | Huang | |
| 5,927,164 | A | 7/1999 | Anderson et al. | |
| 5,931,318 | A | 8/1999 | Shauo | |
| 5,967,641 | A | 10/1999 | Sung et al. | |
| 5,970,553 | A | 10/1999 | Lin | |
| 5,970,828 | A | 10/1999 | Bondhus et al. | |
| 6,033,163 | A | 3/2000 | Anderson et al. | |
| 6,065,598 | A | 5/2000 | Anderson et al. | |
| 6,082,232 | A | 7/2000 | Anderson et al. | |
| 6,085,620 | A | 7/2000 | Anderson et al. | |
| 6,109,147 | A | 8/2000 | Legg | |
| 6,109,148 | A | 8/2000 | Anderson et al. | |
| 6,119,560 | A * | 9/2000 | Anderson et al. | 81/440 |
| 6,119,561 | A | 9/2000 | Anderson et al. | |
| 6,119,859 | A | 9/2000 | Wen | |
| 6,131,222 | A | 10/2000 | Anderson et al. | |
| 6,196,093 | B1 | 3/2001 | Hu | |
| 6,209,428 | B1 | 4/2001 | Anderson et al. | |
| 6,237,451 | B1 | 5/2001 | Wei | |
| 6,243,901 | B1 | 6/2001 | Elsener et al. | |
| 6,243,902 | B1 | 6/2001 | Huang | |
| 6,257,106 | B1 | 7/2001 | Anderson et al. | |
| 6,286,168 | B1 | 9/2001 | Woodruff et al. | |
| 6,286,397 | B1 | 9/2001 | Taggart et al. | |
| 6,298,756 | B1 | 10/2001 | Anderson et al. | |
| 6,305,256 | B1 | 10/2001 | Anderson et al. | |
| 6,308,599 | B1 | 10/2001 | Fu-Hvi | |
| 6,318,218 | B1 | 11/2001 | Anderson et al. | |
| 6,352,010 | B1 | 3/2002 | Giarritta | |
| 6,397,709 | B1 | 6/2002 | Wall | |
| 6,415,923 | B1 | 7/2002 | Chen | |
| 6,435,065 | B2 | 8/2002 | Kozak | |
| 6,634,262 | B2 | 10/2003 | Malchus | |
| 6,634,502 | B1 | 10/2003 | Yu | |
| 6,637,061 | B1 | 10/2003 | Spracklin et al. | |
| 6,751,819 | B2 | 6/2004 | Chuang | |
| 6,752,268 | B1 | 6/2004 | Wadsworth | |
| 6,851,339 | B2 | 2/2005 | Casel | |
| 6,868,760 | B1 | 3/2005 | Johnson | |
| 6,902,356 | B2 | 6/2005 | Breitenmoser | |
| 6,915,900 | B2 | 7/2005 | Chen | |
| 6,941,843 | B2 | 9/2005 | Johnson et al. | |
| 6,968,760 | B2 | 11/2005 | Hu | |
| 6,976,410 | B2 | 12/2005 | Anderson et al. | |
| 6,983,506 | B1 | 1/2006 | Brown | |
| 7,011,212 | B2 | 3/2006 | Thomson | |
| 7,032,750 | B2 | 4/2006 | Amtenbrink | |
| 7,047,847 | B2 | 5/2006 | Chuang | |
| 7,073,417 | B2 | 7/2006 | Beauchamp | |
| D528,395 | S | 9/2006 | Schluter | |
| 7,146,889 | B2 | 12/2006 | Kang | |
| 7,182,002 | B2 | 2/2007 | Hu | |
| 7,185,569 | B2 | 3/2007 | Knight et al. | |
| D542,111 | S * | 5/2007 | Te | D8/105 |
| 7,281,454 | B2 | 10/2007 | Johnson | |
| 7,281,455 | B2 | 10/2007 | Hu | |
| 7,281,456 | B2 * | 10/2007 | Chiang | 81/440 |
| 7,284,466 | B1 | 10/2007 | Ho | |
| 7,328,796 | B2 | 2/2008 | Brunson | |
| 7,380,660 | B2 | 6/2008 | Lin | |
| 7,383,755 | B1 | 6/2008 | Kang | |
| 7,387,055 | B2 | 6/2008 | Liu | |
| 7,481,137 | B1 * | 1/2009 | Johnson | 81/440 |
| 7,530,129 | B2 | 5/2009 | Yale | |
| 7,530,459 | B2 | 5/2009 | Yeh | |
| 8,430,003 | B1 | 4/2013 | Johnson | |
| 8,783,138 | B2 * | 7/2014 | Johnson | 81/439 |

* cited by examiner

LOCKING MECHANISM AND TOOL DEVICE

CROSS REFERENCE TO RELATED APPLICATIONS

The present application is a continuation-in-part application that claims the benefit of a co-pending, non-provisional patent application entitled "High Density Tool and Locking Mechanism," which was filed on Jun. 8, 2010, as Ser. No. 12/796,262, which claims priority benefit to three (3) provisional patent applications, as follows: (i) a first provisional application entitled "Split Tools," which was filed on Jun. 9, 2009, as Ser. No. 61/268,135; (ii) a second provisional application entitled "Split Tools," which was filed on Sep. 11, 2009, as Ser. No. 61/276,376; and (iii) a third provisional application entitled "High Density Tool and Locking System," which was filed on Apr. 12, 2010, as Ser. No. 61/342,375. The entire content of the foregoing applications is incorporated herein by reference.

FIELD OF THE INVENTION

This invention relates to better methods of producing hand tools that store and make readily accessible a greater quantity of tools to perform a given task. The noted objectives are realized by unique techniques of tool storage and retrieval from within the space provided in the handles of both manual hand tools and power hand tools.

BACKGROUND OF THE INVENTION

Hand toolkits consisting of folding elongated tools and hand toolkits comprised of a handle with a driver shaft that accept interchangeable tool bits have long benefited tradesmen, hobbyist and homeowners alike. These toolkits generally include a plurality of related tools arranged in an assortment of sizes for a given tool type, such as screwdrivers, hex wrenches and Torx drivers, or arranged as a variety of tools each with different functions that might be used to perform a given undertaking, such as sets of common tools for repairing a bicycle or tools commonly used by fishermen. It is conceivable that manual or power hand toolkits of this nature can be produced to benefit any conceivable sport, hobby or trade.

Although tradesmen, hobbyists and homeowners are benefited with the convenience of an organized set of tools situated in a common holder to perform the task at hand, often they have had to depend on the relatively small assortment of tools contained in a toolkit before accessing additional tools to finish a task from a separate toolbox or storage device. An example might be that to perform a given task, the user may not know by visual inspection if a metric or fractional-inch (SAE) hex wrench is needed or might require a set of both metric and SAE hex wrenches and would presently have to rely on two separate toolkits.

Thus, a need exists for improved toolkits and systems that better meet the needs of tradesmen, hobbyists and/or homeowners. Such needs are satisfied according to the present disclosure through advantageous toolkits and systems. Thus, in exemplary embodiments, the present disclosure provides toolkits/systems that are able to accommodate both a full set of common metric and SAE hex wrenches in one toolkit. Additional advantages of this invention include mechanisms for retaining stored tools in location for storage, selection and use using either semi-secure or positive locking mechanisms. Additional advantageous features, functions and benefits of the present invention will be apparent from the description which follows, particularly when read in conjunction with the accompanying figures.

SUMMARY OF THE INVENTION

The present invention is generally directed to a hand tool/system that includes a handle with access from one or more sides to provide tool storage and retrieval. The hand tool/system also generally includes one or more multi-chambered tool bit cartridges that are either fixed or pivoting for tool storage and one or more tool drivers that are either fixed or pivoting. In addition, semi-secure and/or positive engagement locking mechanisms can be applied to the design of the multi-chambered tool bit cartridge and/or tool driver depending upon the design specifications and/or desired functional operation of implementations hereof.

The object of this invention pertains to optimizing the greatest quantity of fastener tool bits and extended folding tools that can be stored and carried in an organized fashion within the confines of a standard size tool handle, including features that allow greater flexibility in how they are used. The purpose of which is to provide the user of a given hand tool, regardless if it's a manual hand tool or a power hand tool, the means to perform a given task right in the palm of his/her hand, minimizing the need to retrieve additional similar tools or tool bits from a separate storage device. A standard size tool handle is defined as what has been found through decades of hand tool design to be a comfortable size that fits in the average size hand of a tradesman or do-it-yourselfer.

To achieve this stated objective, it is important to define the type or function, size range, access and arrangement of the tool bits or extended tools that can be comfortably accommodated within the confines of a tool handle. In that tool bits such as ¼ inch hex bit that has a function as a slotted, Phillips, hex, Torx, square or posi driver bit offer overall geometric dimensions that are relatively uniform in size for a given length, ¼ inch hex bits that function as nut drivers as well as sockets range considerably in the overall diameter in comparison to the size of the drive connection as well as from one another as they relate to the size of the specific fastener they are used for. For these reason different approaches to the design of multi-chambered tool bit cartridge has to be considered. Both fixed and pivoting multi-chambered tool bit cartridges are required to achieve an appropriate solution and to accomplish the stated object of this invention. Additionally, a feature that makes possible multiple size tool bit drivers to accommodate multiple size tool bit drive connections in the same size hand tool assembly without consuming additional space will equally apply to extended folding tools and therefore is also included as a solution to the stated objective of this invention.

To accumulate and access the maximum quantity of fastener tools it is important to first design a storage device that will keep each fastener tool in close proximity to each other as well as aligning each tool along the common geometric consistencies that exist between each tool in a X, Y, Z matrix that exploits these consistencies. Second it is important to provide access great enough to be able to pluck a given tool from the storage device given the limitations imposed in selecting and securely grasping a relatively small object. Thirdly, assuming that there is sufficient room within the confines of the hand tool handle, access to a second matrix on the reverse side of the storage device provides for the accumulation of additional fastener tools. Fourthly, considerations for strengthening a tool handle that has a large open portion in its center to accommodate a multi-chambered tool bit cartridge. Complying to the parameters of these four imposed design conditions and to accommodate the greatest selection of fastener tools the storage device must provide tool retrieval and storage in a three dimensional matrix of multiple columns and rows located on selective planes and that provides access from one or more sides. Additionally, depending upon the swing radius imposed by the geometry of the tools also influences the geometry of the tool holder; the tool holder can be of a flat design fixed within the tool handle or of a pivoting design that rotates from a secure home position for storage to an open and exposed position for selection.

The various objectives and advantages described in this summary of this present invention will be more readily understood from the following detailed description when read in conjunction with the appended drawings.

BRIEF DESCRIPTION OF THE DRAWINGS

To assist those of ordinary skill in the art in making and using the disclosed toolkits/systems, reference is made to the accompanying figures, wherein.

DETAILED DESCRIPTION OF EXEMPLARY EMBODIMENTS

Figure 1:
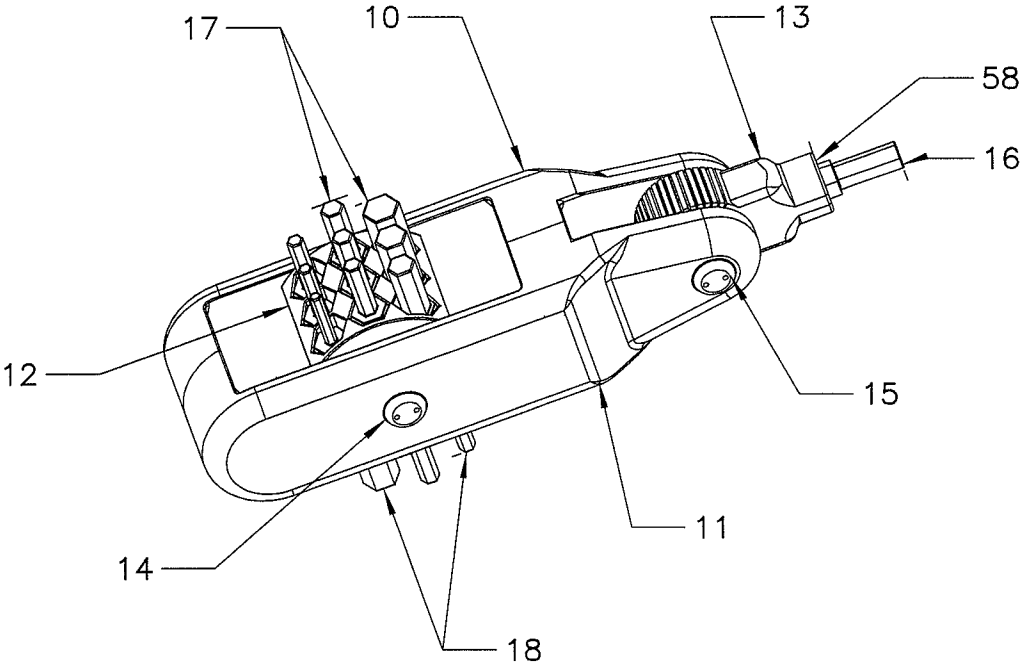
FIG. 1 Depicts a folding toolkit with a multi-chambered tool bit cartridge and tool driver in an extended and open position.

According to an exemplary embodiment of the present disclosure, FIG. 1 is an isometric view of a hand toolkit instrument which embodies a positional multi-chambered tool bit cartridge 12 in its open position for tool bit selection and a positional tool bit driver 13 in an open position for use. The handle sections 10 and 11 are shown to be held together with fastener components 14 and 15 although other means of joining the handle sections such as sonic welding or rivets could be employed. In some instances the handle could be a single component rather than two halves. An assortment of tool bits 17 and 18 are arranged on two ends of the multi-chambered tool bit cartridge 12 and fully exposed for selection. A tool bit 16 has been selected and inserted into a mating chamber 58 located in tool bit driver 13 for use.

Figure 2:
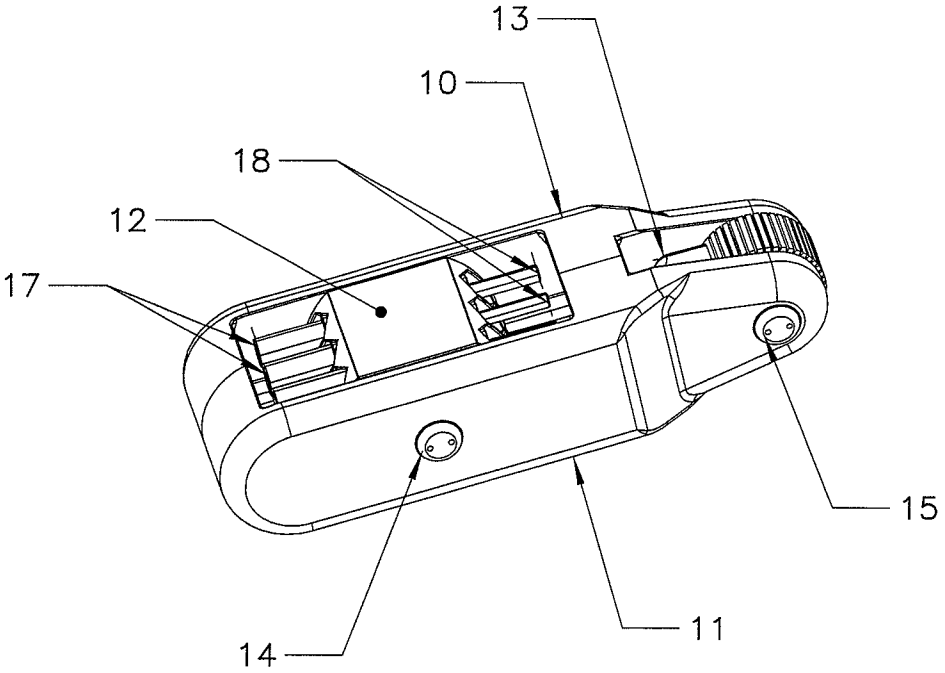
FIG. 2 Depicts a folding toolkit with a multi-chambered tool bit cartridge and tool driver in a retracted and closed position.

FIG. 2 is the same hand toolkit instrument as in FIG. 1, an isometric view which embodies a positional multi-chambered tool bit cartridge 12 in its closed or home position the tool bit driver 13 in a closed or home position and contained within the handle sections 10 and 11.

Figure 3:
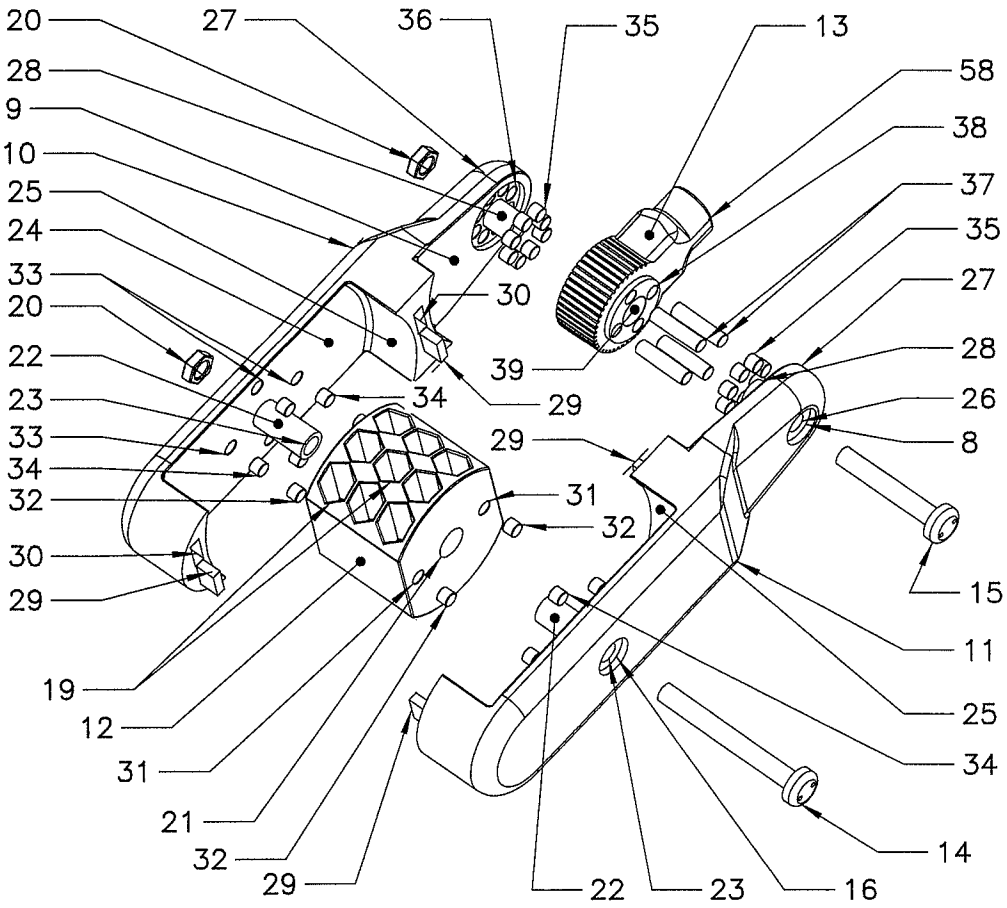
FIG. 3 An exploded view shows the same toolkit as in FIG. 1 and FIG. 2.

FIG. 3 is an exploded isometric view that illustrates assembly and positioning features of the present invention more clearly. The multi-chambered tool bit cartridge 12 revolves around a tubular shaped axle sleeve 22 shown here to be in two sections and attached to handle sections 10 and 11 although other manifestations of axle 22 can produce its same primary functions. In this view axle sleeve 22 has the functions of being the pivot point 21 for the multi-chambered tool bit cartridge 12, provide a pathway 23 to connect fastener components 14 and 20 to hold the handle sections 10 and 11 together and to perform the function of being a spacer that will prevent handle sections 10 and 11 from being compressed and thus rub against the multi-chambered tool bit cartridge 12 and restrict free rotation of the tool bit cartridge and assist in transferring torsion forces when applied during use more uniformly between both halves of the handle sections 10 and 11. Hole feature 30 mates with stem feature 29 to add additional strength. A small clearance gap between the inner walls 24 of handle section 10 and 11 should be maintained to allow free rotation and effective positioning of the multi-chambered tool bit cartridge 12. Located in the side walls of the multi-chambered tool bit cartridge 12 are hole provisions 31 that accommodate plugs 32, similarly hole provisions 33 are located in the inner walls 24 of the handle sections 10 and 11 that accommodate plugs 34.

The plugs located in both the handle sections and the tool bit cartridge are situated along equal circumscribed circumferences and can be situated on both sides of the tool bit cartridge and handles or one side of the tool bit cartridge and the same side of the handle that the one side flanks. There are two arrangements that the plugs 32 and 34 can comply with that will produce semi-secure positioning arraignments for the multi-chambered tool bit cartridge 12. First, both plugs 32 and 34 can be magnets with opposing magnetic fields attracting one another to a selected semi-secure position. Second either plug 32 or plug 34 can be magnets with the other being of a ferromagnetic material to attract the magnet. As a minimum, only one plug 32 or 34 located in the cartridge or handles is required to be a magnet while the quantity and angular placement of opposing magnets or ferromagnetic plugs located in the side walls of the flanking components along the circumscribed circumferences will determine the number and location of semi-secure positions for the multi-chambered tool bit cartridge 12. The same is true for the tool bit driver portion of the hand toolkit instrument. Where plugs 35 are situated in hole provisions 36 of the inside wall 9 of handle sections 10 and 11 and plugs 37 located in hole provisions 38 of the tool bit driver 13. Additionally, the tool bit driver 13 revolves around axle 28 shown here to be in two sections and attached to handle sections 10 and 11 although other manifestations of axle sleeve 28 can produce its primary functions. In this view axle sleeve 28 has the functions of being the pivot point 39 for the tool bit driver 13, provide a pathway 26 to connect fastener components 15 and 20 and to perform the function of being a spacer that will prevent handle sections 10 and 11 from being compressed and thus rub against the tool bit driver 13 and restrict free rotation of the tool bit driver.

A small clearance gap between the inner walls 9 of handle section 10 and 11 should be maintained to allow free rotation and effective positioning. Stem feature 29 along with the mating hole feature 30 with one or more locations on handle sections 10 and 11 add additional strength to the hand toolkit instrument especially when significant torque is applied to the tool bit driver. Another embodiment of this invention is the relationship between the inside wall radius 25 of handle sections 10 and 11 and the outside of the protruding end of tool bits 17 and 18 (shown in FIG. 1 and FIG. 2). Inside wall radius 25 performs several functions that include giving clearance for the tool bits 17 and 18 in that the they mimic a similar but slightly smaller radius when the multi-chambered tool bit cartridge 12 is pivoted to its closed and home position, the close proximity of the inside wall radius 25 prevents tool bits 17 and 18 from dislodging from multi-chambered tool bit cartridge 12 should the hand toolkit instrument be dropped or jostled and the shape of the radius 25 adds significant strength to the handle sections 10 and 11. This is further exampled in FIG. 7.

Figure 4:
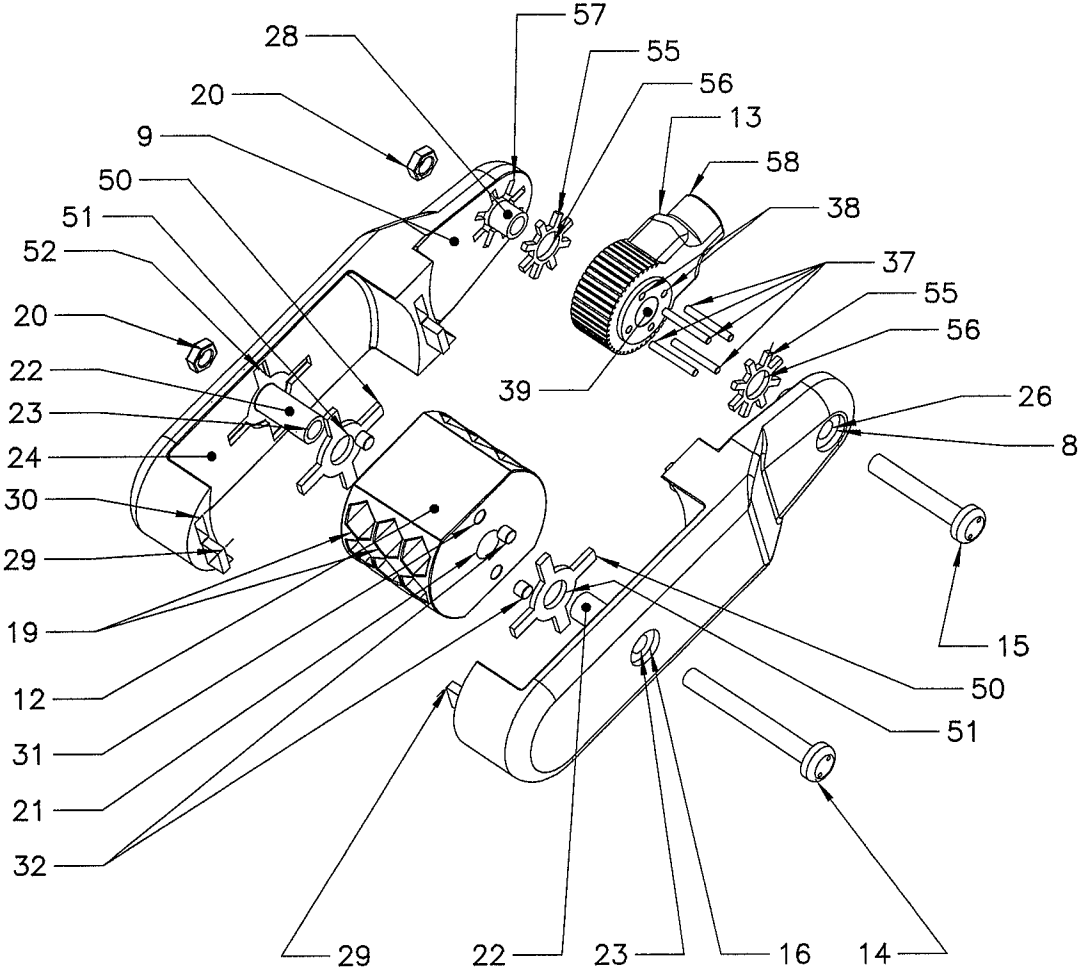
FIG. 4 A similar exploded view to that of FIG. 3 with similar features except with differences with semi-secure positioning approaches between FIG. 3 and FIG. 4 for the multi-chambered tool bit cartridge and tool driver FIG. 5 An exploded view of a folding toolkit with a multi-chambered tool bit cartridge and tool driver but of a simple design.

The types of magnets that will function best are permanent magnets that do not require a keeper or shunt to maintain the integrity of the magnet. A rare earth neodymium magnet is preferable. Other optional methods of maintaining the position of the multi-chambered tool bit cartridge 12 and bit driver 13 in relation to handle sections 10 and 11 are with a detent device such as a ball detent, a floating plate multiple position detent, a mechanical feature that provides a detent between the tool bit cartridge and handle as well as the tool bit driver and handle or a feature that provides friction between the handle and multi-chambered tool bit cartridge and/or tool bit driver A similar exploded isometric view is shown in FIG. 4 is to that of FIG. 3. The exception is that in place of hole provisions 33 and 36 as well as plugs 34 and 35 shown in FIG. 3, in FIG. 4 there are shown positioning plates 50 and 55 that situate in mating holes 52 and 57 respectfully. The positioning plates can be magnets or of a ferromagnetic material in a similar arrangement as they relate to similar components outlined in the description of FIG. 3. The quantity and angular placement of opposing magnets or ferromagnetic fingers located on the plates and in the side walls of the flanking components along the circumscribed circumferences will determine the number and location of semi-secure positions for the multi-chambered tool bit cartridge 12 and tool bit driver 13.

Figure 5:
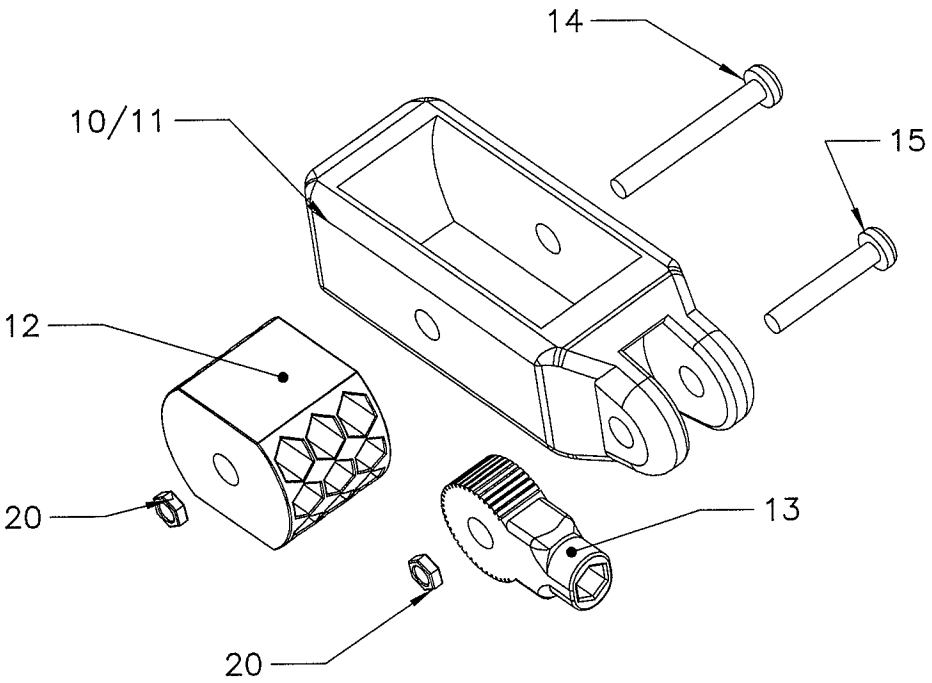

FIG. 5 depicts an exploded view of a hand toolkit instrument with a multi-chambered tool bit cartridge 12 and tool driver 13 but of a simple design including a one piece handle 10/11 with semi-secure positioning by applying friction between the handle 10/11 and tool bit cartridge 12 and the handle 10/11 and driver 13 by tightening fasteners 14, 15 and 20. All other positioning features as described in FIG. 3 and FIG. 4 are not included in this manifestation. Although any degree of complexity as described in FIG. 3 and FIG. 4 can conceivably be added to the hand toolkit instrument shown in FIG. 5.

Figure 6:
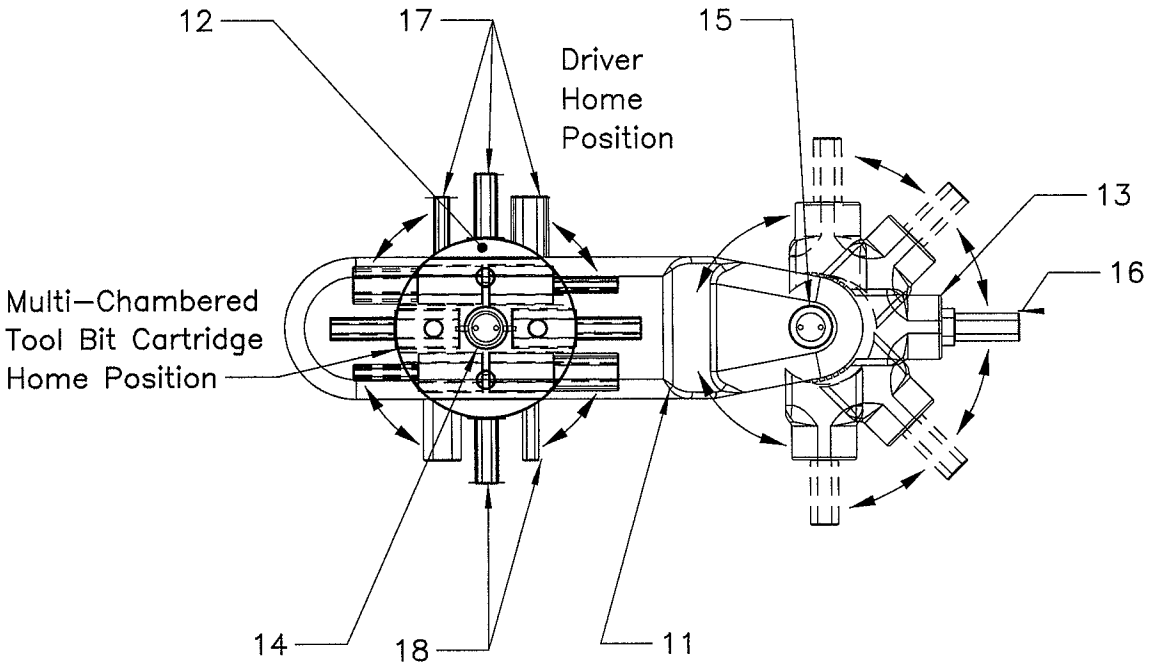
FIG. 6 This hand tool is similar in design to that shown in FIG. 1 displaying in phantom view example of multiple positions that the multi-chambered tool bit cartridge and tool bit driver can pivot.

FIG. 6 illustrates the hand toolkit instrument shown in FIG. 1 in phantom view and is one example of multiple positions that the multi-chambered tool bit cartridge 12 and tool bit driver 13 can pivot in relationship to the handle 11 in semi-secured or a locked positions.

Figure 7:
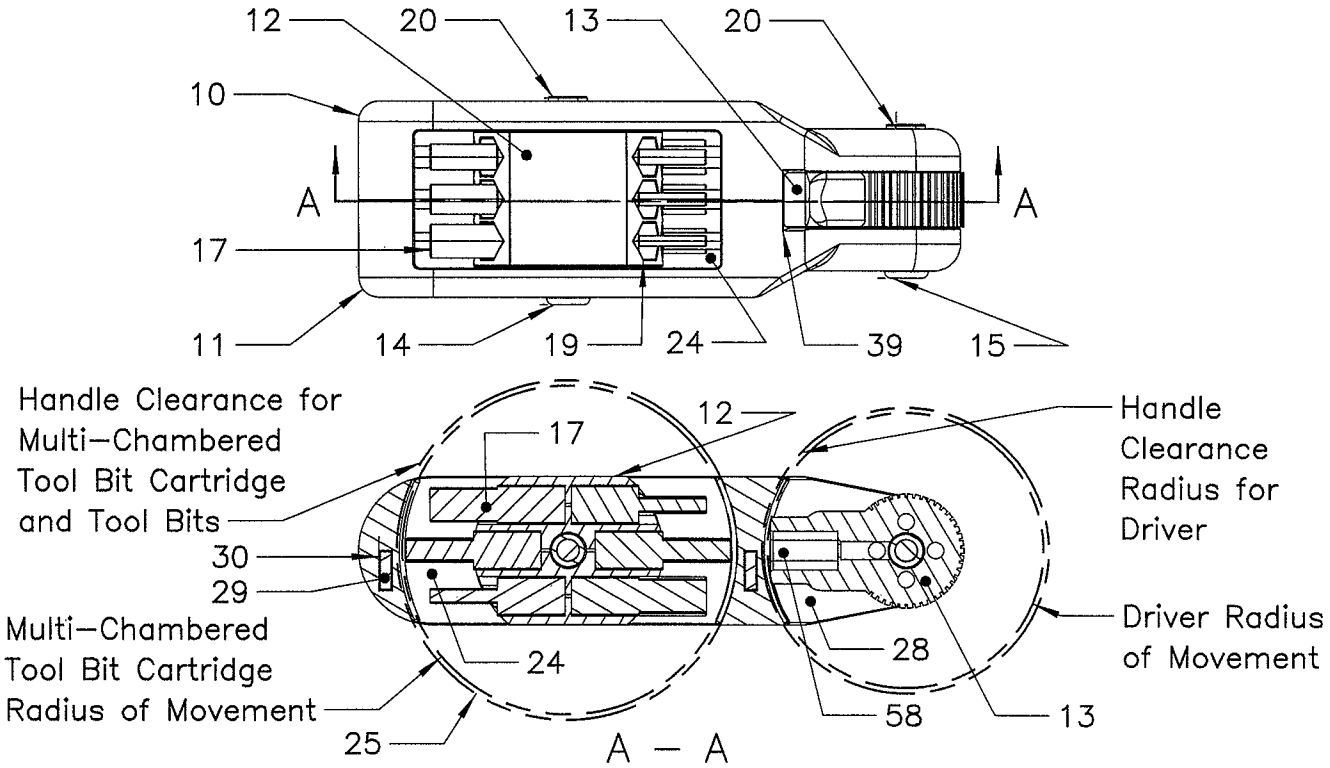
FIG. 7 A top view and sectional view of a hand tool component swing radiuses and similar in design to that shown in FIG. 2.

FIG. 7 is a top view and sectional view of a hand tool similar in design to that shown in FIG. 2 with the multi-chambered tool bit cartridge 12 and bit driver 13 in closed or home positions. The pivoting radius of both the multi-chambered tool bit cartridge 12 equipped with tools and tool bit driver 13 are shown as well as their respective handle clearance radius. The tool bit cartridge radius in relationship to the handle clearance radius 25 is important for retaining the tool bits in there chambers and prevents spillage should the hand tool instrument be dropped or jostled while the tool bit cartridge is in its closed and home location.

Figure 8:
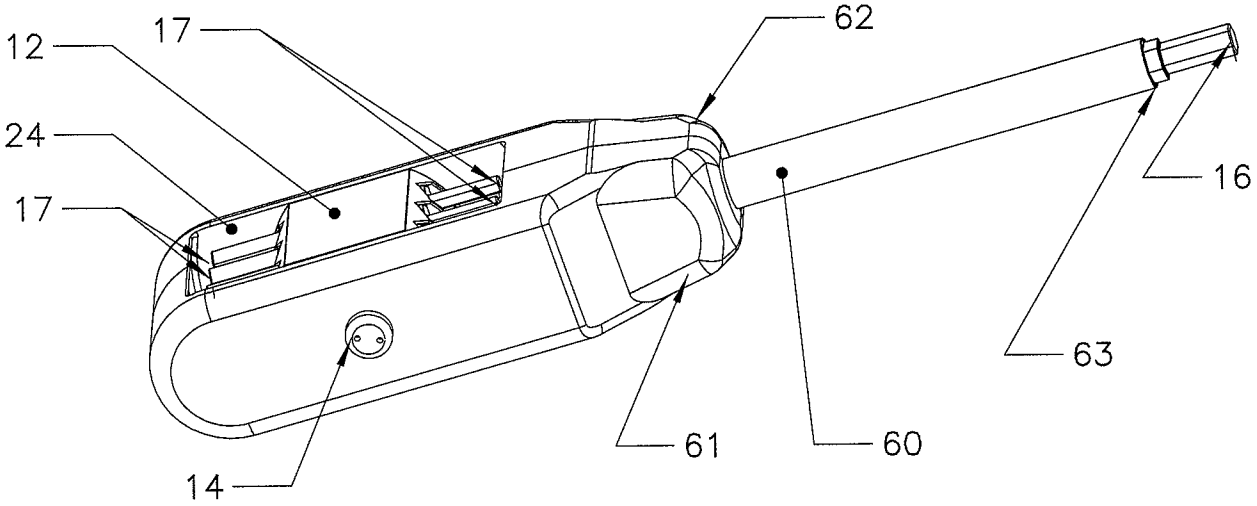
FIG. 8 Depicts a folding toolkit with a multi-chambered tool bit cartridge in a retracted and closed position and fixed (non-rotating) tool driver.

FIG. 8 further exemplifies the design flexibility of this invention displaying a folding toolkit with a multi-chambered tool bit cartridge 12 in a retracted and closed position and fixed (non-rotating) tool driver stem 60.

Figure 9:
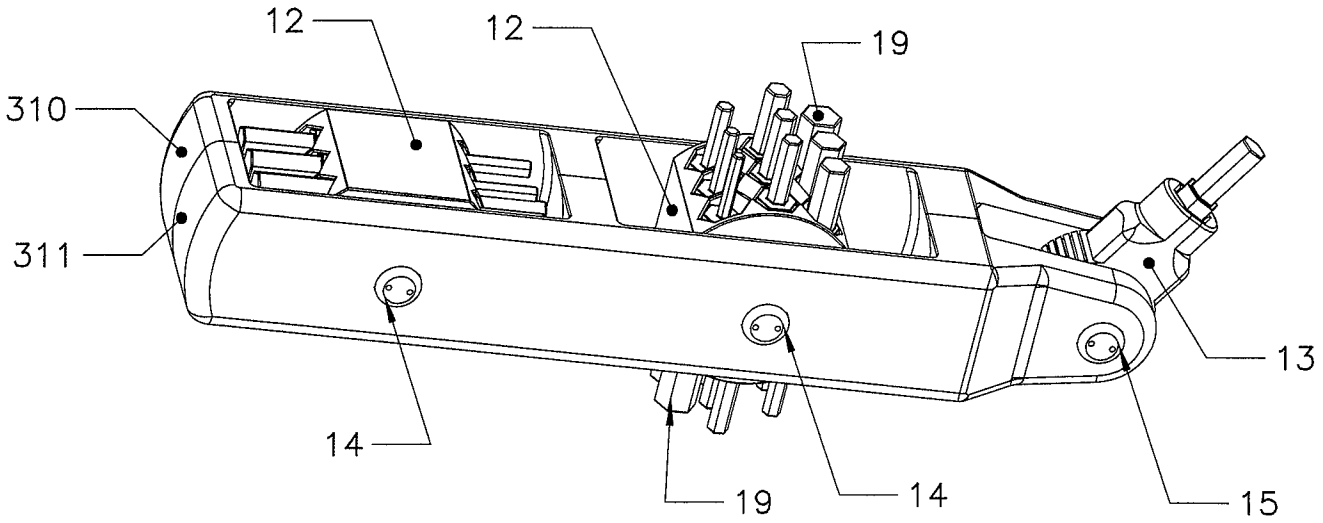
FIG. 9 Depicts a folding toolkit with more than one multi-chambered tool bit cartridge and one tool driver in various positions.

FIG. 9 illustrates with the use of similar design features as in FIG. 1 and demonstrates how the quantity of tool bits can be increased as well as contained and accessed with the use of additional multi-chambered tool bit cartridges 12 with within the handle sections 310 and 311.

FIG. 10 through 20 and FIG. 30 are examples of various multi-chambered tool bit cartridge designs and features. Although some of the examples differ in appearance they all exhibit the primary design parameters which are at the focal point of this invention which is the design of a hand tool system that will store and make accessible for selection and use the utmost quantity of fastener tools within the confines of the hand tool handle. This is accomplished by associating the common geometric consistencies that exist between each bit tool in a X, Y, Z matrix, providing access to the multi-chambered tool bit cartridge from more than one side in a radial or axial orientation either for purposes of accessing a particular tool bit or swing clearance of the tool bit cartridge. When required, aligning rows or columns associated with the X and Y axis on different plane levels (or differences in the mounted height of a tool bit) as associated with the Z axis. The examples shown here are a selection of multi-chambered tool bit cartridge designs and features, they are not an absolute accounting of all designs. Given the wide range of function and size of tool bits and sockets including such items as slotted, Phillips, hex, Torx, square and posi driver bits, nut drivers and sockets, drill bits and tap bits that can be accommodated in such a system it would be impractical to give examples of every design. Although the means for manufacturing and the material used for a given multi-chambered tool bit cartridge may vary, injection molding of a semi ridged elastomeric material may prove to be most effective.

Figure 10:
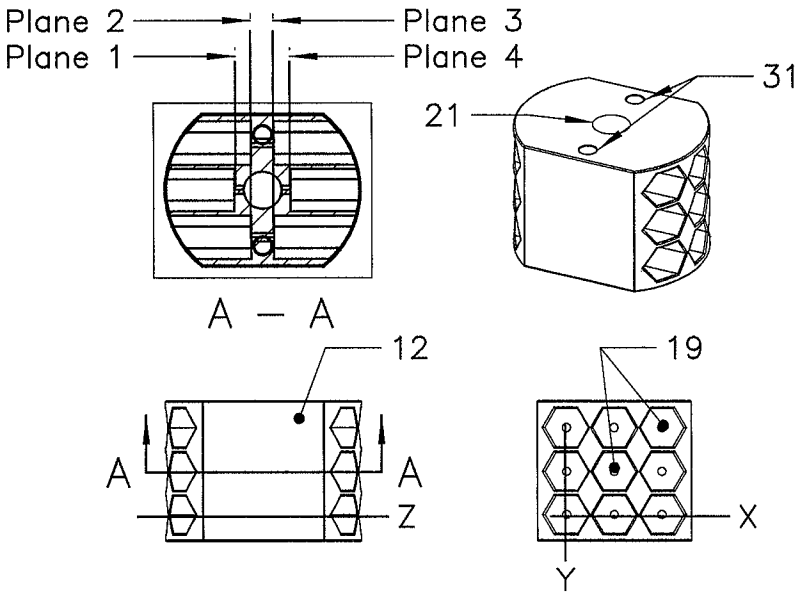
FIG. 10 Multiple views of a multi-chambered tool bit cartridge that allows for tool bits to be inserted from two sides of the cartridge.
Figure 11:
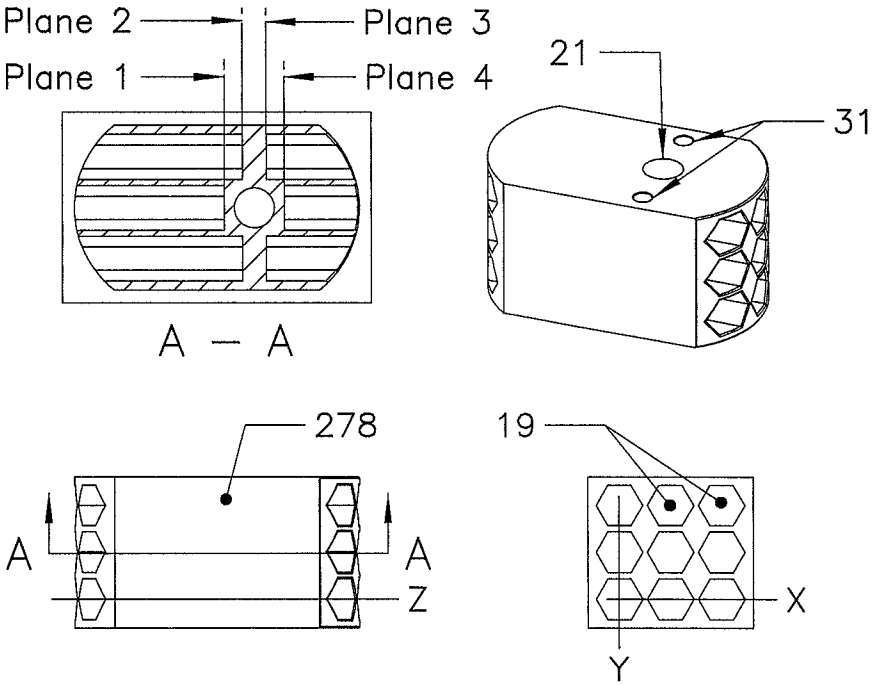
FIG. 11 Multiple views of a multi-chambered tool bit cartridge that allows for different size tool bits to be inserted from two sides of the cartridge. Also shown is an off-center axis of rotation.
Figure 12:
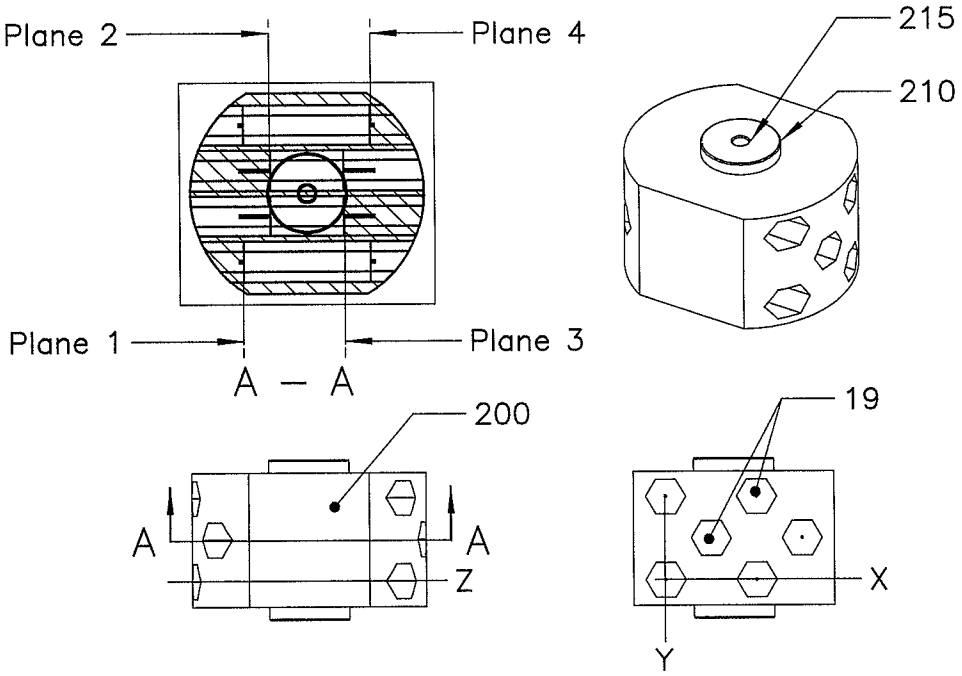
FIG. 12 Multiple views of a multi-chambered tool bit cartridge that allows for long tool bits to be inserted from two sides of the cartridge in a staggered arrangement.
Figure 13:
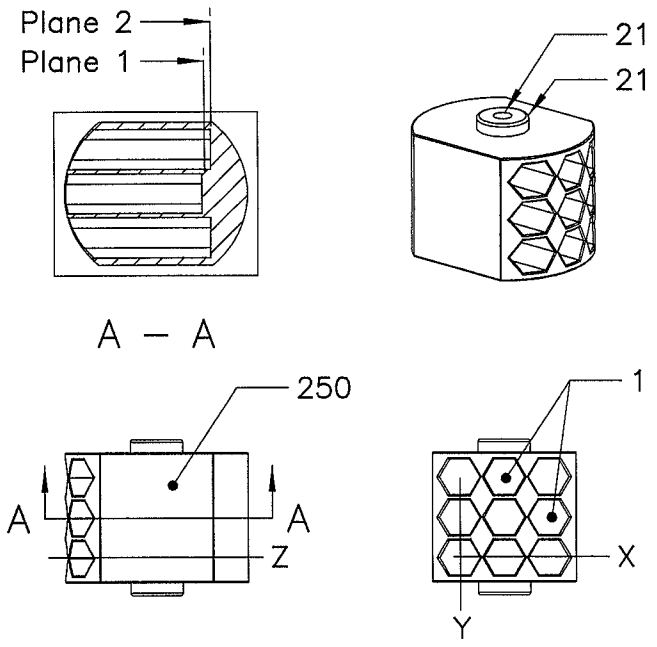
FIG. 13 Multiple views of a multi-chambered tool bit cartridge that allows for long tool bits to be inserted from one side of the cartridge as well as an external axis.
Figure 14:
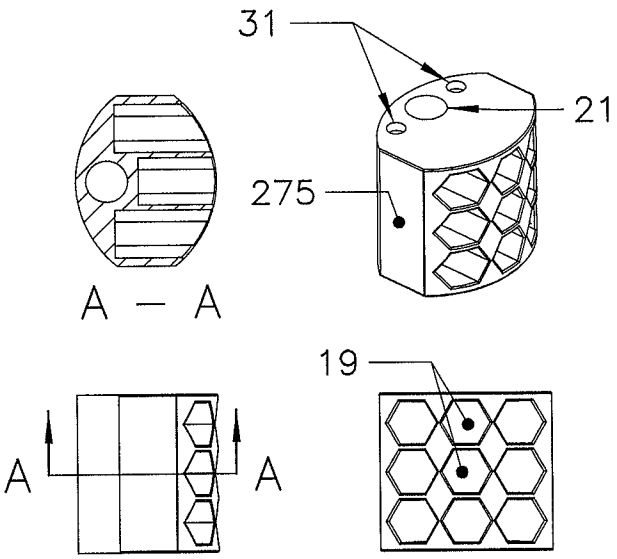
FIG. 14 Multiple views of a multi-chambered tool bit cartridge that allows for short tool bits to be inserted from one side of the cartridge. Also shown is an off-center axis of rotation.
Figure 15:
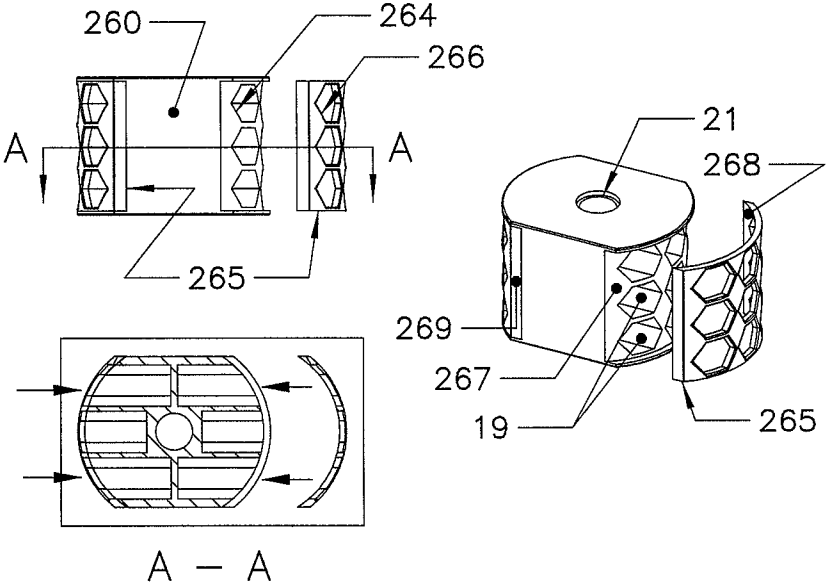
FIG. 15 Multiple views of a multi-chambered tool bit cartridge that allows for tool bits to be inserted from two sides of the cartridge and an elastomeric over-mold clad to each chambered face of the cartridge.
Figure 16:
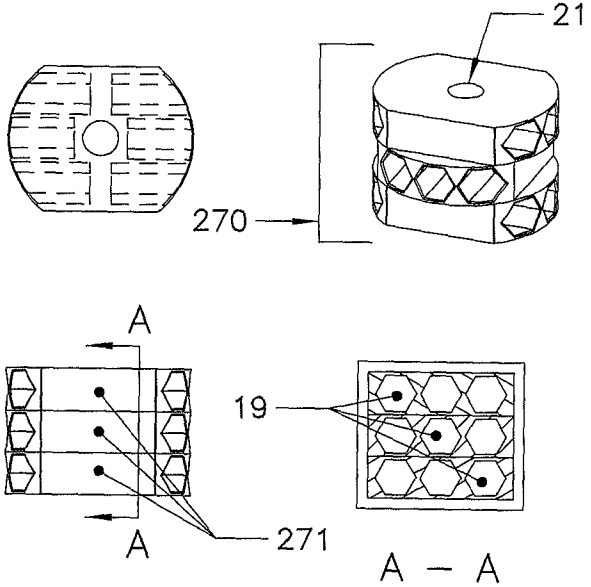
FIG. 16 Multiple views of several multi-chambered tool bit cartridge ganged together that allows for tool bits to be inserted from two sides of the cartridge.
Figure 17:
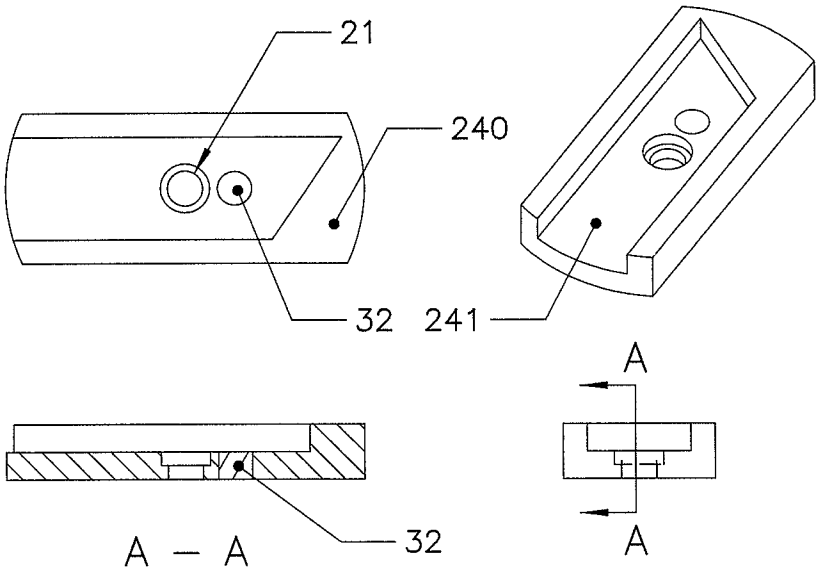
FIG. 17 Multiple views of a single-chambered side wall tool cartridge.
Figure 18:
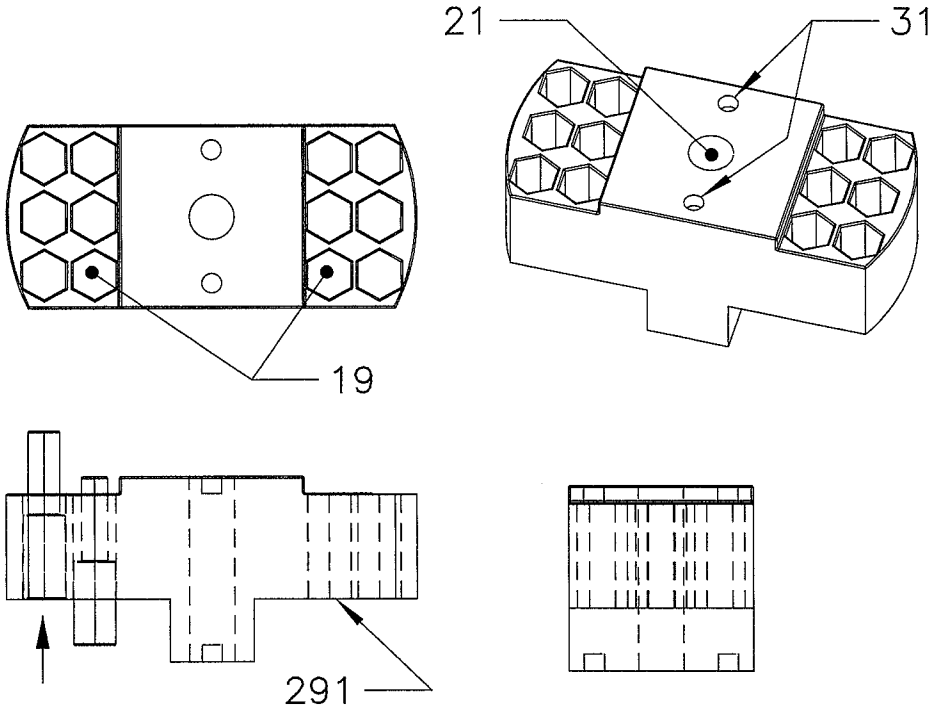
FIG. 18 Multiple views of multi-chambered tool bit cartridge with tool bit chambers perpendicular to the cartridge axis of rotation.
Figure 19:
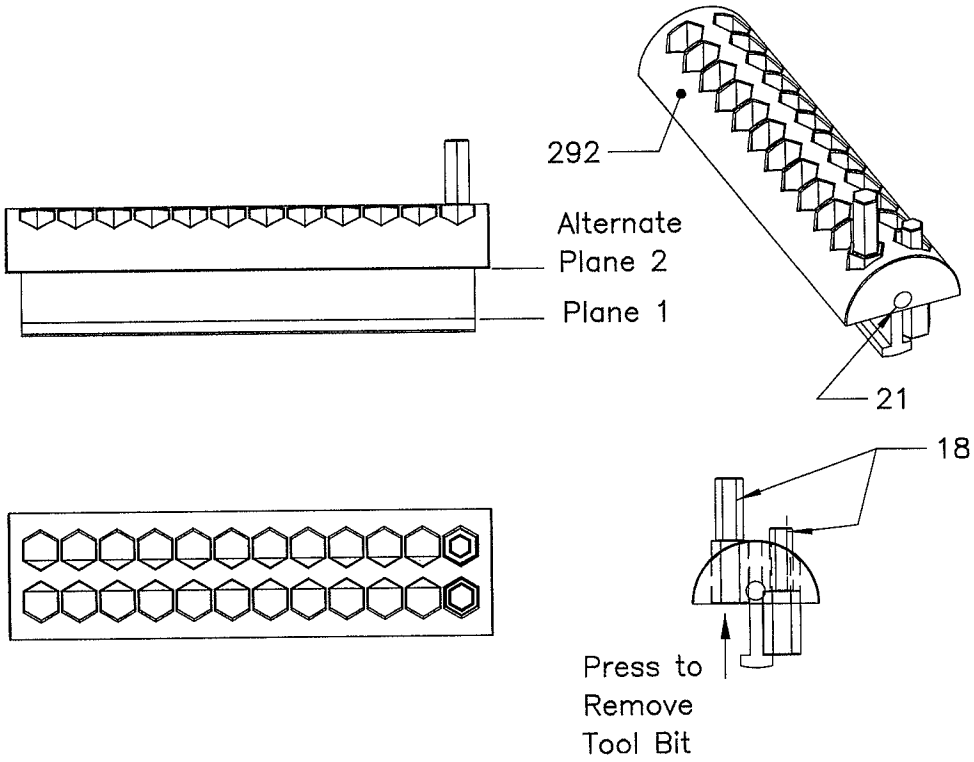
FIG. 19 Multiple views of multi-chambered tool bit cartridge that is parallel mounted in relation to the handle.

FIG. 10 displays a similar multi-chambered tool bit cartridge 12 as shown in FIG. 1 with features consistent with the intention of this invention including an X, Y and Z matrix, multiple planes and use of two sides of the tool bit cartridge. Feature 21 is a central pivot point and features 31 are components for a semi-secure positioning function. FIG. 11 differs from FIG. 10 demonstrating the ability to accept tool bits of different lengths using an offsetting pivot point 21. Illustrated in FIG. 12 is a feature to accommodate tool bits that are longer than the radius of the multi-chambered tool bit cartridge 200 in a staggered arrangement. To accomplish this axle bearing 210 protruding from each side wall of the tool bit cartridge and is designed to fit into and pivot in the handle of the hand toolkit instrument. This frees the core of the tool bit cartridge by not requiring a pivot point to protrude through the core of the tool bit cartridge. FIG. 13 is equipped with the same axel bearings 210 as shown in FIG. 12 and able to accommodate long tool bits but the tool bits are accessed from one side of the tool bit cartridge in a non-staggered matrix. FIG. 14 accommodates short tool bits from one side and features an offset pivot point 21. Shown in FIG. 15 is Item 265, an elastomeric overmold with an inside surface 268 that is clad to the outside surface of the multi-chambered tool bit cartridge 260. The purpose of this feature is to allow for a strong tool bit cartridge made from a hard material to be used while at the same time the elastomeric overmold 265 will grip the tool bit and hold it in place until selected. Additionally the tool bit access holes 266 in the elastomeric overmold 265 can be made slightly smaller than the access holes 264 located in the tool bit cartridge so as to apply additional gripping frictional force to the tool bit. Multiple views show in FIG. 16 are of several multi-chambered tool bit cartridges 271 ganged together along a common axis and that allows for a single cartridge or multiple tool bit cartridges to be selected. FIG. 17 is of a single-chambered tool bit cartridge for multiple tool bits 240. In this instance the tool bits are razor knife blades. In that there is standardization in size of razor knife blades and that they have a flat profile, they can be grouped in a single chamber 241. Transversely mounted in relation to the handle shown in FIG. 18 or parallel mounted in relation to the handle as shown in FIG. 19 tool bit chambers 19 of multi-chambered tool bit cartridge 290 and 292 can be situated closely together due to step feature 291 and 293 respectively.

Figure 20:
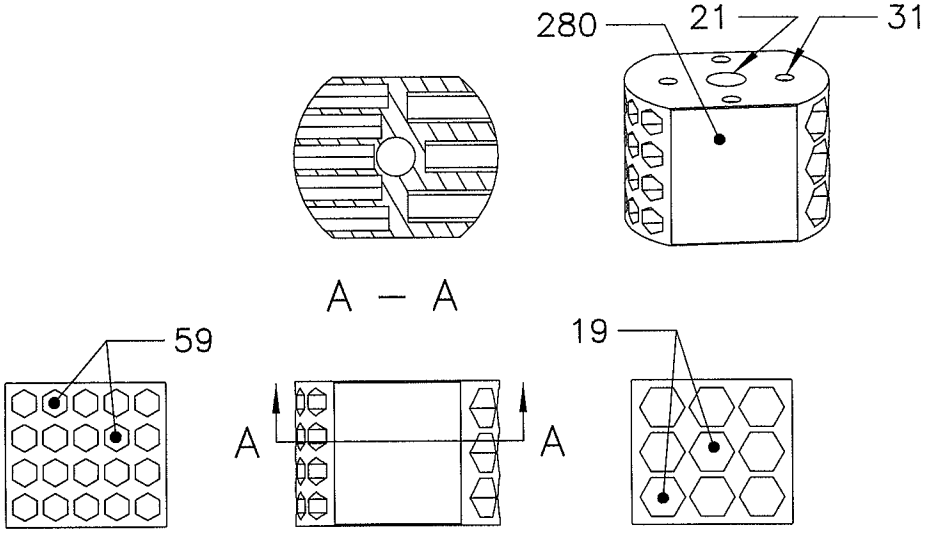
FIG. 20 Multiple views of a multi-chambered tool bit cartridge that allows for tool bits of different sizes to be inserted from each side of the cartridge.

Step feature 291 allows for a portion of the tool bit to hang in free space which forms the first plane while step feature 293 is also equipped with backstop feature 294. The backstop feature 294 allows for seating of a tool bit to a prescribed depth while still allowing for access to the aft end of the tool bit. To select a given tool bit that is shown mounted in either FIG. 18, FIG. 19 or FIG. 30 one would push on the back side of the aft end of the tool bit which in turn would slide it forward into an alternate plane that is aligned with feature 291 or 293 in relation to the remaining stored tool bits that maintain their position at the first plane and allow the tool bit that has been slid to the alternate or second plane to be gripped and removed from the tool bit cartridge. The multi-chambered tool bit cartridge 280 shown in FIG. 20 is similar to the tool bit cartridge shown in FIG. 10 with the except that one side of the tool bit cartridge is designed to accept tool bits that are larger in cross section 19 than the tool bits on the opposing side that are smaller in cross section 59. It becomes apparent that more than one size tool bit can fit into a single multi-chambered tool bit cartridge 280 however the first issue that this presents revolves around the size of the tool bit that the tool bit driver 13 can hold as shown in FIG. 1 which will only accept one size tool bit. The second issue revolves around accommodating a second tool bit driver in the same location and consuming the same space that is available for a single tool bit driver.

Figure 21:
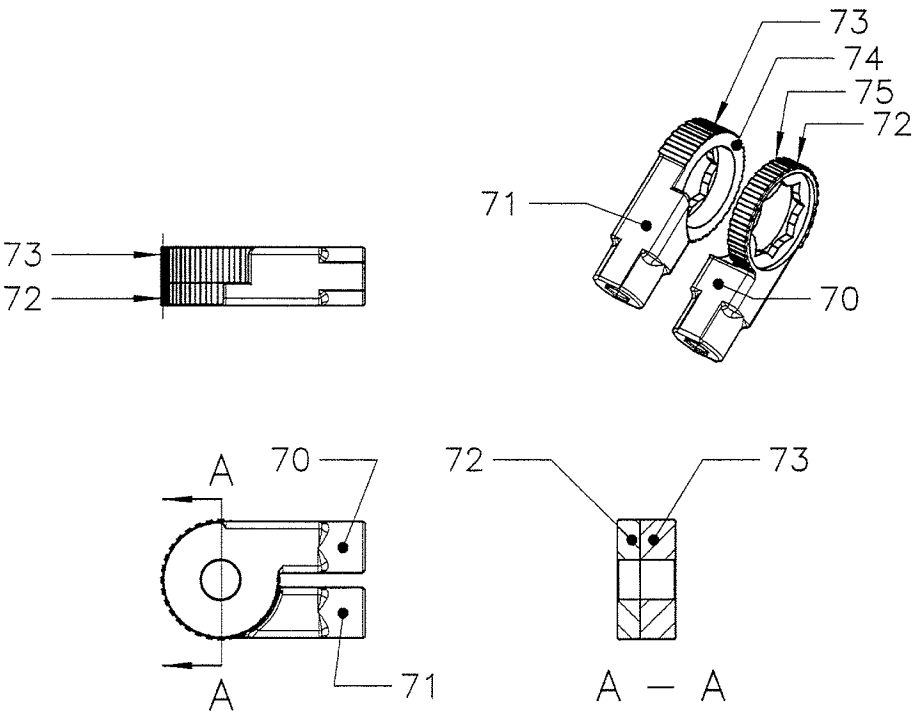
FIG. 21 Multiple views of split tool bit holders that function in conjunction with the multi-chambered tool bit cartridge shown in FIG. 20.

A solution can be found in FIG. 21; multiple views of split tool bit holders shown in FIG. 21 allow for two size tool bit holders 72 and 73 to accommodate the two different size tool bit cross sections 19 and 59. A set of split tool bit holders as shown in FIG. 21 can be designed in coordination with the multi-chambered tool bit cartridge shown in FIG. 20 where as two or more bit holders can consume the same width as a single bit holder with the strength that is required for the larger of the two bits to be emphasized with a greater cross sectional area at its aft end 73 than that of the smaller bit holder's cross sectional area at its aft end 72. In an adjacent and opposed arrangement for mating two dimensionally dissimilar tool bit holders made of similar materials while not exceeding the size of the larger tool bit holder and to obtain the optimal strength for each tool bit holder, an approximation can be calculated.

A1=larger extended tool bit cross sectional area

A2=smaller extended tool bit cross sectional area $A1+(A1-A2)(A2)/A1$=cross sectional area of the aft end for the larger tool 73

$A1-(A1-A2)(A2)/A1$=cross sectional area of the aft end for the smaller tool 72

Figure 22:
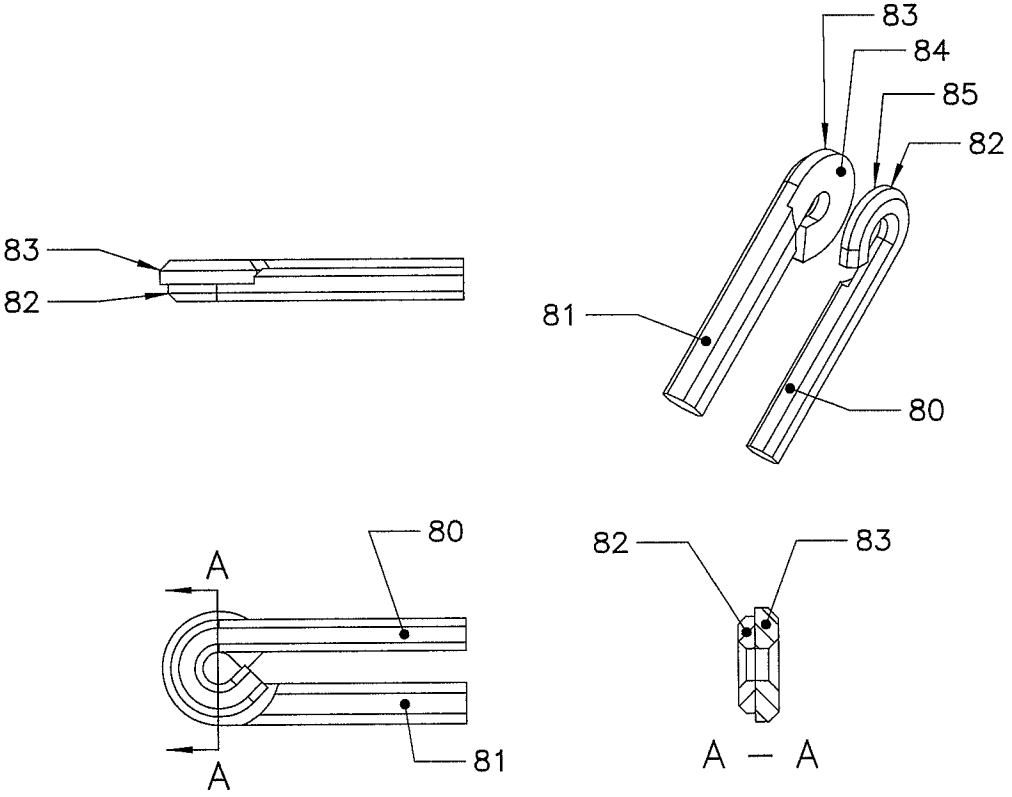
FIG. 22 Multiple views of extended tools in a similar arrangement to FIG. 21.

In this arrangement, the pivoting aft end of each tool bit driver 70 and 71 will align axially at the side face 74 and side face 75 while each of the working ends of tool bit drivers 70 and 71 consume the same cross sectional area as tool bit driver 13 shown in FIG. 1 except that they are offset by two times the height as well as any web clearance that may be required in the design of the tool handle and that depending on the orientation of the hand tool instrument, one of the tool bit drivers 70 and 71 will pivot clockwise and the other will pivot counter clockwise into position for use. For the same reason as described in the explanation of the solution outlined in FIG. 21, extended tools dissimilar in size and with lug aft ends as well as extended looped tools as shown in FIG. 22 where one extended tool might be of metric dimensions and the other fractional inch dimensions the same formula an approximation can be applied thusly as long as all dimensions are translated to the same units.

A1=larger extended tool shank cross sectional area

A2=smaller extended tool shank cross sectional area $A1+(A1-A2)(A2)/A1$=cross sectional area of the aft end for the larger tool 83

$A1-(A1-A2)(A2)/A1$=cross sectional area of the aft end for the smaller tool 82

The same would hold true when mating two extended looped tools made of similar materials but of dimensionally dissimilar sizes in an adjacent and opposed arrangement and aligned on a common shaft and that have uniformly circular geometries or regular polygons that are configured using an inscribed circle while not exceeding the size of the larger diametrical extended tool D1 when mated along surfaces 84 and 85 then, the dimensions for the diameter can be substituted for the cross sectional area and an approximation is calculated thusly.

D1=larger extended tool cross sectional area

D2=smaller extended tool cross sectional area

T=thickness of tool aft end $D1+(D1-D2)(D2)/D1=T1$ for the larger diameter tool 83

$D1-(D1-D2)(D2)/D1)=T2$ for the smaller tool 82

Figure 23:
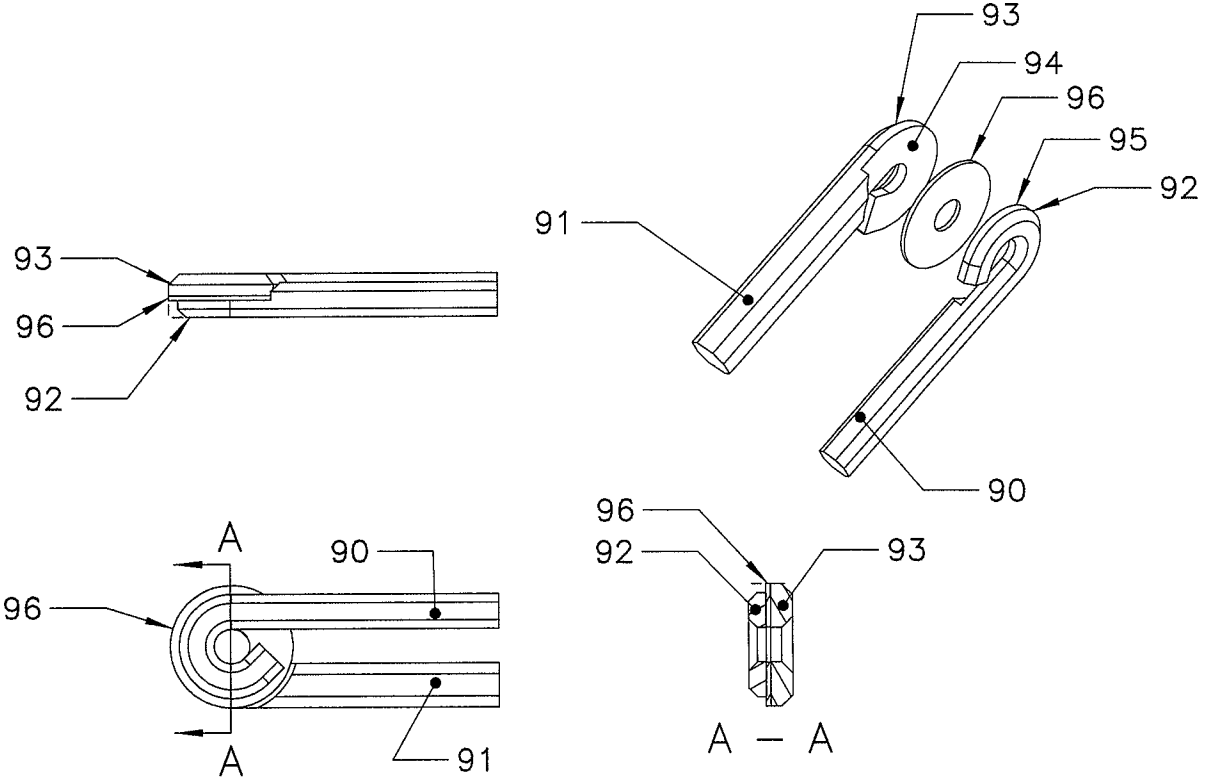
FIG. 23 Multiple views of extended tools with spacer in a similar arrangement to FIG. 21 and FIG. 22.

Multiple views of extended tools with spacer in a similar arrangement to FIG. 21 and FIG. 22 are shown in FIG. 23 that also shows spacer 96. Spacers either in a washer form or attached to the handle are often used for strength, alignment and to reduce friction between the mating surfaces, in this instance surfaces 94 and 95. Optimizing the strength of each diametrical extended tool aft end can be a significant a design factor when two extended tools aft ends are occupying the same thickness as the thickness of the shank of the larger extended tool. A spacer can be used with accommodations for the geometrical differences between the two tools by proportionally subtracting the thickness of the spacer from each extended tool aft end while using the above formulas or the thickness of a spacer (S) an approximation can easily be calculated in a more simple form.

R1=larger extended tool radius 93

R2=smaller extended tool radius 92

S=thickness of a spacer if it is to be used 96

$R1-R2=S$ (thickness of the spacer)

This would therefore allow extended tool with either lug or looped aft ends to conform to the object of this invention. Till now, extended hex toolkits that are mounted in descending order according to size and pivot on a shaft from a home position of a common handle in metric sizes are supplied as a separate toolkit than toolkits of fractional inch (SAE) size of a similar arrangement. By using the above formula and as an example, arranging the metric extended tools on one of the open sides of the handle and the SAE size extended tools on the opposing open side of the handle it is now possible to provide a single hand toolkit instrument that includes two full sets of tools, one being metric extended tools in a descending order and the other being SAE extended tools in an accompanying descending order. One set will pivot clockwise and the other will pivot counter clockwise into position for use.

In addition to the exemplary formulas provided above, in some exemplary embodiments, the formulas and examples discussed below can be implemented for a determination of dissimilar tool element sizes, e.g., the split tool bit holders and the split tools of FIGS. 21-23. The formulas and examples provided herein for the tool bit holders are based upon the capacity to carry a specific size tool bit relative to another dissimilar size tool bit fitted into different tool bit holders that have the capacity to carry the dissimilar tool bits when the tool holders are arranged in an adjacent and opposing arrangement for the primary purpose of increasing the number of tool bit holders within the width of a handle cavity. The formulas and examples provided herein also apply to tools based upon the capacity to carry a specific size tool relative to another dissimilar size tool that are arranged in an adjacent and opposing arrangement for the primary purpose of increasing the number of tools within the width of a handle cavity. The exemplary calculations assume that the bending and/or tensional moments of the materials used are substantially similar between the two dissimilar sized tools or tool bits, as well as the two dissimilar sized tool bit holders. However, the formulas provided herein can be implemented for determining the dissimilar tool element sizes for tools, tool bits and/or tool bit holders of a variety of materials of fabrication.

In discussing the below formulas, it should be understood that each of the tool bit holders or tools defines a proximal end and a distal end. It should be understood that the proximal end is the end of the tool bit holder or tool which defines the pivot point or shaft attachment point for the tool bit holder or tool relative to the toolkit. Each of the proximal ends further defines respective proximal end widths. It should further be understood that the distal end is the end of the tool bit holder or tool which opposes the proximal end of the tool bit holder or tool, e.g., the end which receives the tool bits or the end which defines the actual tool to be utilized. Each of the distal ends further defines respective distal end widths. With respect to the tool bit holder distal end, it should be understood that the distal end defines a distal end width of the overall tool bit holder and a cavity centered within the distal end width for receiving tool bits. The variables or factors in the exemplary formulas are as follows:

The first example relates to the determination of proximal end widths for the split tool bit holders, e.g., tool bit holders or drivers 70 and 71 of FIG. 21, which receive dissimilar size tool bits and are arranged in an adjacent and opposing arrangement. The proximal end widths can be determined by:

Db1=diameter or inscribed circle of larger tool bit shank uniformly circular geometries or regular polygons (large tool bit width, diameter or inscribed circle)

Db2=diameter or inscribed circle of smaller tool bit shank uniformly circular geometries or regular polygons (small tool bit width, diameter or inscribed circle)

Tb1=Thickness or width of larger proximal end based on the tool bit diameter or inscribed circle based on Wc (large tool bit holder proximal end width)

Tb2=Thickness or width of smaller proximal end based on the tool bit diameter or inscribed circle based on Wc (small tool bit holder proximal end width)

Wc=Web Clearance for combined dissimilar sized tool bit holders or width of the cavity betwixt the side walls (clearance between wing or ear sections 27)

$$Wc+[(Db1-Db2)(Db2/Db1)]/2=Tb1=\text{large tool bit holder proximal end width}$$

$$Wc-[(Db1-Db2)(1-Db2/Db1)]/2=Tb2=\text{small tool bit holder proximal end width}$$

For example, if the large tool bit width, diameter or inscribed circle to be inserted into the large tool bit holder is approximately 0.25 inches, i.e., Db1=0.25 inches, the small tool bit width, diameter or inscribed circle to be inserted into the small tool bit holder is approximately 0.125 inches, i.e., Db2=0.125 inches, and the clearance between the cavity side walls is approximately 0.4 inches, i.e., Wc=0.4 inches, the above formulas can be utilized to solve for the large and small tool bit holder proximal end widths. In particular, based on these dimensions, the large tool bit holder proximal end width can be calculated as approximately 0.231 inches, i.e., Tb1=0.231 inches, and the small tool bit holder proximal end width can be calculated as approximately 0.169 inches, i.e., Tb2=0.169 inches. The dissimilar proximal end widths are thus optimized to provide the greatest possible thickness and/or strength proportional to the dimensions of the tool bits received in the respective tool bit holders and the tool bit holder distal end widths. Since the proximal end widths are a fraction of the respective distal end widths, when the proximal ends of the tool bit holders are placed in an adjacent and opposing relation, the combined proximal end width, i.e., Tb1 plus Tb2, is approximately 0.4 inches. The tool bit holders placed in an adjacent arrangement thereby fit within the side walls of the cavity. Although this example illustrates the proximal end widths as dimensionally dissimilar, in some exemplary embodiments, the proximal end widths may be dimensionally similar in size. Further it should be understood that the overall distal end width of the tool bit holders cannot exceed the cavity width, e.g., 0.4 inches in the above example. In some exemplary embodiments, the cavity clearance value, i.e., Wc, used in the formulas may be selected to be slightly smaller than the actual cavity clearance to ensure that the tool bit holders fit within the cavity clearance. In addition, at least one of the proximal end widths is greater than half of the larger distal end widths. In the above example, at least one of the proximal end widths, i.e., Tb1 of 0.231 inches, is greater than half of the larger distal end width, e.g., 0.4/2=0.2 inches.

The below examples relate to the determination of proximal end widths for extended tools, e.g., the extended tools of FIG. 22, which are of dissimilar sizes and are arranged in an adjacent and opposing arrangement. The proximal end widths can be determined by:

D1=width, diameter or inscribed circle of larger tool shank uniformly circular geometries or regular polygons (large tool distal end width, diameter or inscribed circle)

D2=width, diameter or inscribed circle of smaller tool shank uniformly circular geometries or regular polygons (small tool distal end width, diameter or inscribed circle)

T1=Thickness or width of larger tool proximal end (large tool proximal end width)

T2=Thickness or width of smaller tool proximal end (small tool proximal end width)

$$D1+[(D1-D2)(D2/D1)]/2=T1=\text{large tool proximal end width}$$

$$D2+[(D1-D2)(1-D2/D1)]/2=T2=\text{small tool proximal end width}$$

For example, if the large tool distal end width, diameter or inscribed circle is approximately 0.25 inches, i.e., D1=0.25 inches, and the small tool distal end width, diameter or inscribed circle is approximately 0.125 inches, i.e., D2=0.125 inches, the above formulas can be utilized to solve for the large and small tool proximal end widths. In particular, based on these dimensions, the large tool proximal end width can be calculated as approximately 0.156 inches, i.e., T1=0.156 inches, and the small tool proximal end width can be calculated as approximately 0.094 inches, i.e., T2=0.094 inches. Similar to the above example, the dissimilar proximal end widths are optimized to provide the greatest possible thickness and/or strength proportional to the distal end widths of the tools being utilized. When the dissimilar proximal ends of the tools are placed in an adjacent and opposing relation, the combined proximal end width, i.e., T1 plus T2, is approximately 0.25 inches. Thus, the two tools, when placed in an adjacent and opposing arrangement, fit into the same space as one tool normally would and at least one of the proximal end widths is greater than half of the larger distal end width. In the above example, at least one of the proximal end widths, i.e., T1 of 0.156 inches, is greater than half of the larger distal end width, i.e., D1/2=0.125 inches. In addition, the second proximal end width, i.e., T2 of 0.094 inches, is greater than half of the second distal end width, i.e., D2/2=0.625 inches.

As an additional example for the determination of proximal end widths for extended tools, e.g., the extended tools of FIG. 22, the below formulas can be implemented for tools of different units, e.g., metric units and fractional inch (SAE) units, by converting all dimensions to the same units. The proximal end widths can be determined by:

D1=width, diameter or inscribed circle of larger tool shank uniformly circular geometries or regular polygons (large tool distal end width, diameter or inscribed circle)

D2=width, diameter or inscribed circle of smaller tool shank uniformly circular geometries or regular polygons (small tool distal end width, diameter or inscribed circle)

T1=Thickness or width of larger tool proximal end (large tool proximal end width)

T2=Thickness or width of smaller tool proximal end (small tool proximal end width)

$$D1+[(D1-D2)(D2/D1)]/2=T1=\text{large tool proximal end width}$$

$$D2+[(D1-D2)(1-D2/D1)]/2=T2=\text{small tool proximal end width}$$

For example, if the large tool distal end width, diameter or inscribed circle is approximately 8 mm (or 0.315 inches), i.e., D1=8 mm or 0.315 inches, and the small tool distal end width, diameter or inscribed circle is approximately 0.25 inches, i.e., D2=0.25 inches, the above formulas can be utilized to solve for the large and small tool proximal end widths. In particular, based on these dimensions, the large tool proximal end width can be calculated as approximately 0.183 inches, i.e., T1=0.183 inches, and the small tool proximal end width can be calculated as approximately 0.132 inches, i.e., T2=0.132 inches. Similar to the above examples, the dissimilar proximal end widths are optimized to provide the greatest possible thickness and/or strength proportional to the distal end widths of the tools being utilized. When the dissimilar proximal ends of the tools are placed in an adjacent and opposing relation, the combined proximal end width, i.e., T1 plus T2, is approximately 0.315 inches. Thus the two tools, when placed in an adjacent and opposing arrangement, fit into the same space as one tool normally would and at least one of the proximal end widths is greater than half of the larger distal end width. In the above example, at least one of the proximal end widths, i.e., T1 of 0.183 inches, is greater than half of the larger distal end width, i.e., D1/2=0.1575 inches. In addition, the second proximal end width, i.e., T2 of 0.132 inches, is greater than half of the second distal end width, i.e., D2/2=0.125 inches. The above examples and formulas illustrate the ability to calculate the proximal end widths for the tool elements, e.g., tool bit holders, tools, and the like, to proportionally size the proximal end widths such that two tool elements can be adjacently placed relative to each other to fit into the same space as one tool normally would. Thus, the amount and/or variety of tools utilized with the exemplary toolkits can be increased while maintaining the overall size of the toolkit. Although the above examples refer to two tool bit holders or tools placed in a cavity, it should be understood that multiple sets of tool elements with proximal and distal ends could be placed within the cavity of exemplary toolkits.

Figure 24:
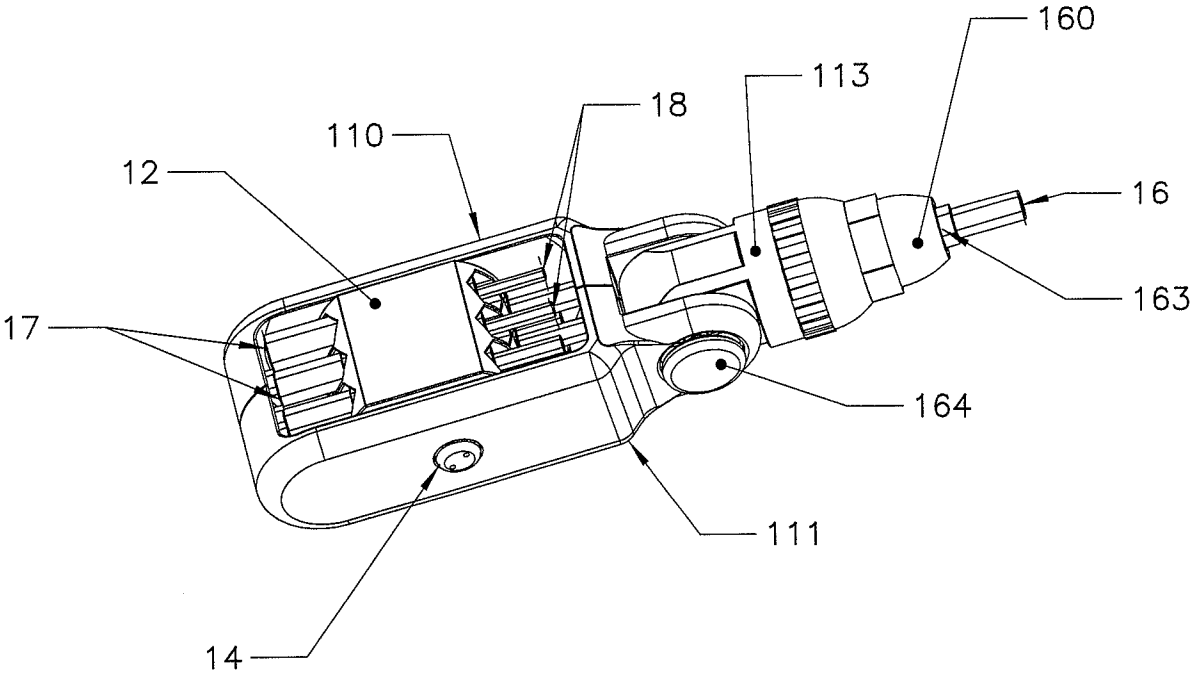
FIG. 24 Depicts a folding toolkit with a multi-chambered tool bit cartridge in a retracted and closed position and with a ratchet bit driver.

FIG. 24 is an isometric view of a hand toolkit instrument which embodies a positional multi-chambered tool bit cartridge 12 in its closed position for tool bit storage and a positional ratchet tool bit driver 160 in an open position for use contained within and in relation to the handle sections 110 and 111. Although a ratchet tool bit driver is shown other tool driver such as socket tool drivers chuck drivers or collet drivers could also be employed. The handle sections 110 and 110 are shown to be held together with fastener components 14. An assortment of tool bits 17 and 18 are arranged on two ends of the multi-chambered tool bit cartridge 12 and maintained in a closed and stored position. A tool bit 16 has been selected and inserted into a mating chamber 163 located in ratchet tool bit driver 160 for use. Push button 164 is located on the side of handle section 111 and interconnects with the ratchet driver holder 113.

Figure 25:
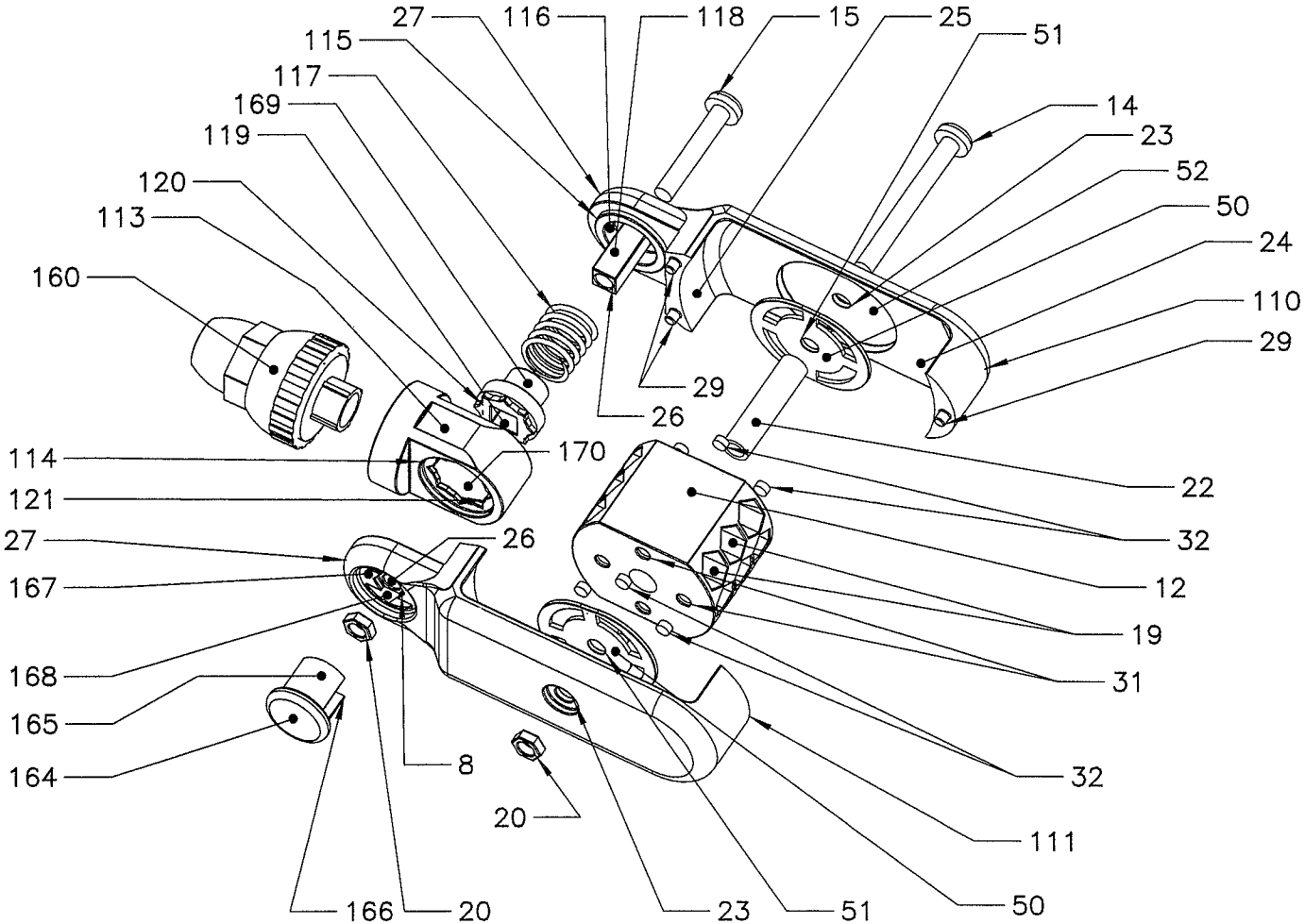
FIG. 25 This exploded view shows the same toolkit as in FIG. 24 and is equipped with a multi-chambered tool bit cartridge and ratcheting bit driver with a positive locking mechanism along with a split handle.

FIG. 25 is an exploded isometric view that illustrates assembly and positioning features of the present invention more clearly. The multi-chambered tool bit cartridge 12 revolves around axle sleeve 22 shown here to be a separate component located between handle sections 110 and 111. In this view axle sleeve 22 has the functions of being the pivot point for the multi-chambered tool bit cartridge 12, provide a pathway 23 and 51 to connect fastener components 14 and 20 to hold the handle sections 110 and 111 together and to perform the function of being a spacer that will prevent handle sections 110 and 111 from being compressed and thus rub against the multi-chambered tool bit cartridge 12 and restrict free rotation of the tool bit cartridge. Additionally axle 22 assist in transferring torsion forces when applied during use more uniformly between both halves of the handle sections 110 and 111. A small clearance gap between the inner walls 24 of handle section 110 and 111 should be maintained to allow free rotation and effective positioning of the multi-chambered tool bit cartridge 12. Located in the side walls of the multi-chambered tool bit cartridge 12 are hole provisions 31 that accommodate plugs 32. On the inside walls of handle sections 110 and 111 are recessed mounting provisions designed to cradle the ferromagnetic positioning plates 50. The same relationship as described in the descriptions for FIG. 3 and FIG. 4 regarding magnetic and ferromagnetic materials used for the purpose of positioning apply to FIG. 25 in regards to semi-secure positioning of the multi-chambered tool bit cartridge 12. Ratchet assembly 160 is fitted into ratchet holder 113 which also has a second function as a component to a positive engagement multiple position locking mechanism.

The positive engagement multiple position locking mechanism shown in FIG. 25 is a unique device that is incorporated into and contained within the handle sections 110 and 111. Located in handle section 111 is a bridge 167. The bridge has one or more hole provisions 168 that allow the stem 165 of push button 164 to transverse through the hole provision 168 allowing the gap 166 to span the bridge 167 and form a second bridge that is the face of the push button. Bridge 167 can also provide a seat 8 for fastener 20. This allows fastener 15 to pass through handle section 110 using clearance hole 26 which passes through handle sections 110 and 111 and the components that make up the positive engagement multiple position locking mechanism and mate with fastener 20 that is situated between bridge 167 and the second push button bridge of push button component 164. The ability to accommodate fasteners 15 and 20 and connecting the wing or ear sections 27 of handles 110 and 111 add significant strength to the driver portion of the hand toolkit instrument. Linear slide 118 is shown to be attached to handle section 110. Linier slide 118 is slightly smaller in dimensions than the linier lock 169. The geometry of the core 119 of linier lock 169 and the geometry of the external face of the linear slide 118 are such that the linear lock can slide back and forth in one direction along the linear slide but is prevented from rotating about the linear slide thus maintaining the same angular cohesion with the handle sections at all times. The linear slide 118 performs a second function of being a spacer that will prevent the wing or ear sections 27 handle sections 110 and 111 from being compressed and thus rub against the ratchet driver holder 113 and restrict rotation of the ratchet driver holder and allow for the smooth motion of the linear lock 169 along the linear slide 118. Additionally linear slide 118 assists in transferring torsion forces when they are applied during use more uniformly between both of the wing or ear sections 27 of the handle sections 110 and 111. The linear lock 169 is equipped uniformly spaced integrating spline 120. The ratchet driver holder 113 is equipped with a corresponding geometry of uniformly spaced gaps 121. When the hand toolkit instrument is assembled a bias compression spring 117 is fitted into a seat 116 and surrounds the linear slide 118 and a portion of linear lock 169 with one end of the bias compression spring 117 against handle section 110 and the other end against a face of linear lock 169. The opposite end to that of the spring side of the linear lock 169 mates with stem 165 of push button 164 allowing a uniformly spaced integrating spline 120 of the linear lock 169 to integrate with the corresponding geometry of uniformly spaced gaps 121 of the ratchet driver holder 113; fastener 15 is connected with fastener 20 and hold the assembly together. A simulation of this assembly his is shown in the sectional view of FIG. 28 and FIG. 29.

Figure 26:
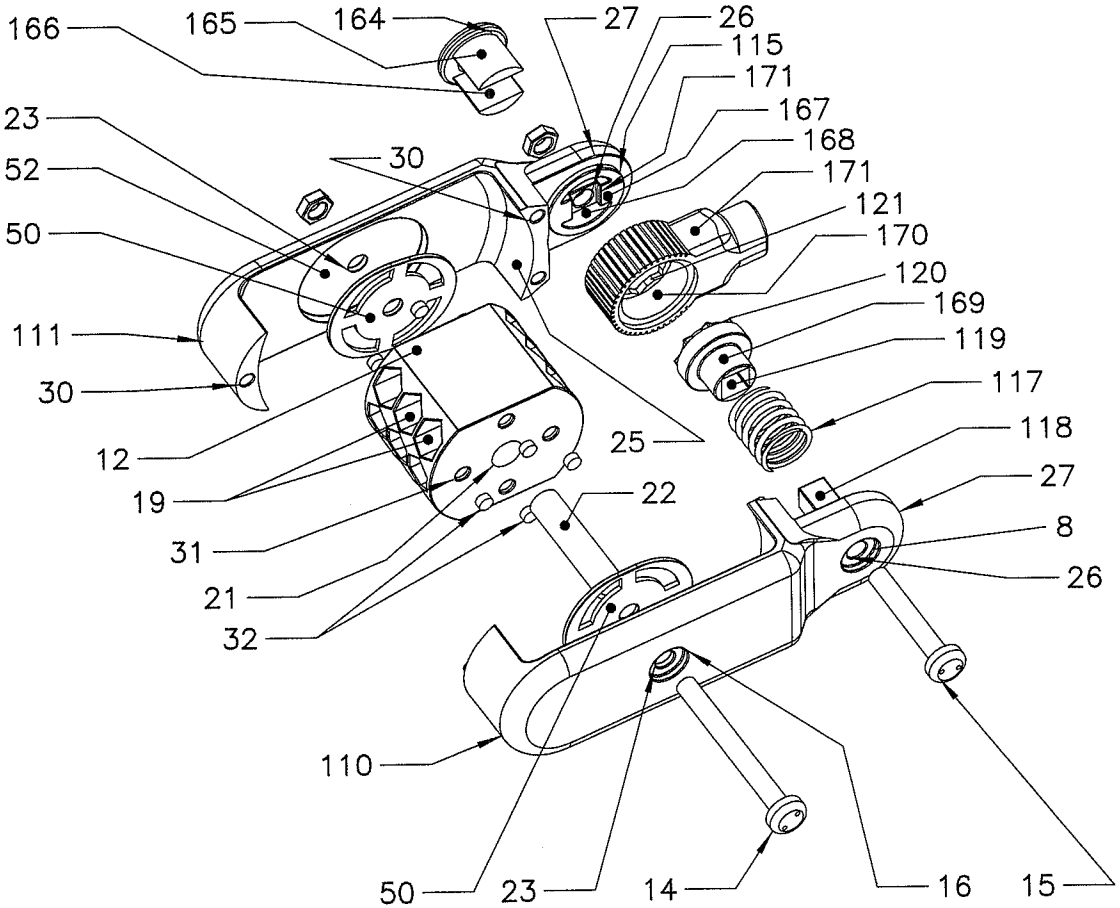
FIG. 26 An exploded view shows the same toolkit as in FIG. 24 and FIG. 25 but with a non-ratcheting bit driver.

FIG. 26 is an exploded isometric view similar to FIG. 25 and that illustrates assembly and positioning features from a different perspective. The difference in description between FIG. 25 and FIG. 26 is that tool bit holder 171 is substituted in FIG. 26 for ratchet assembly 160 and ratchet holder 113 shown in FIG. 25.

Figure 27:
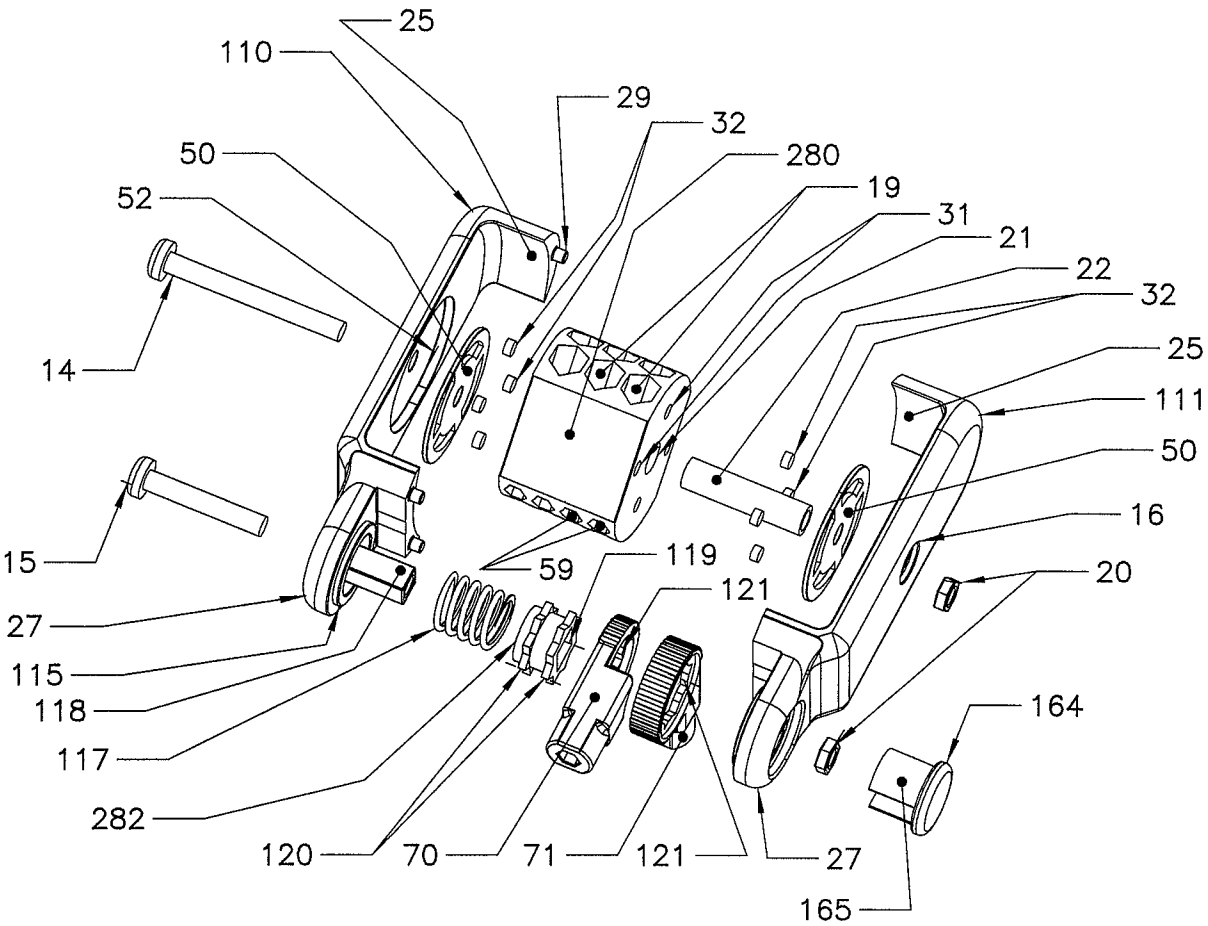
FIG. 27 A similar exploded view to FIG. 26 with similar features except there are two bit drivers as shown in FIG. 21, one each to accommodate two different size tool bits that would fit in the multi-chambered tool bit cartridge shown in FIG. 20.

FIG. 27 is an exploded isometric view similar to FIG. 25 and FIG. 26 and illustrates assembly and positioning features from a different perspective. The difference in description between FIG. 26 and FIG. 27 is that tool bit drivers similar to 70 and 71 that are shown in FIG. 21 have been substituted for the tool bit driver 171 shown in FIG. 26, the multi-chambered tool bit cartridge 12 shown in FIG. 25 and FIG. 26 have been replaced by the multi-chambered tool bit cartridge 280 shown in FIG. 20 and the linear lock 169 has been interchanged with a linear lock 282 that features dual rows of uniformly spaced integrating splines 120. Each row is designed to integrate with the corresponding geometry of uniformly spaced gaps 121 of the tool bit drivers 70 and 71.

Figure 28:
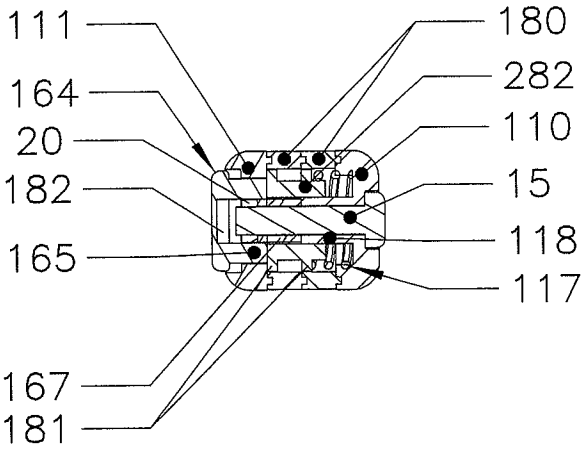
FIG. 28 A sectional view of the positive locking mechanism with two bit holders in a locked position.

FIG. 28 is a sectional view of a positive engagement multiple position locking mechanism in its locked state. The bias spring 117 is pushing away from the handle 110 and against the linear lock 282. The linear lock 282 in turn is forced along the linear slide 118 and to integrate its uniformly spaced spline 120 with the uniformly spaced gaps 121 of drivers 180 at the locations identified as 181. Additionally the linear lock is pushing against the push button stem 165 of push button 164 extending the pushbutton stem through hole provisions 168 that is formed by the bridge 167 and to an outward position increasing the displacement space 182 which is formed above the bridge 167 located in handle section 111 and below the bridge that is formed by the pushbutton stem 165. The handle sections are held together by fastener 15 that extends through the core of the linear slide 118 and other components of the locking mechanism as well as the bridge 167 to fastener 20. This view of the positive engagement multiple position locking mechanism demonstrates a positive engagement system using two drivers 180 however the basic concept can be designed to work with one driver or many drivers as be used to provide a multi-chambered tool bit cartridge as well as other tool devices with a positive engagement multiple position locking mechanism.

Figure 29:
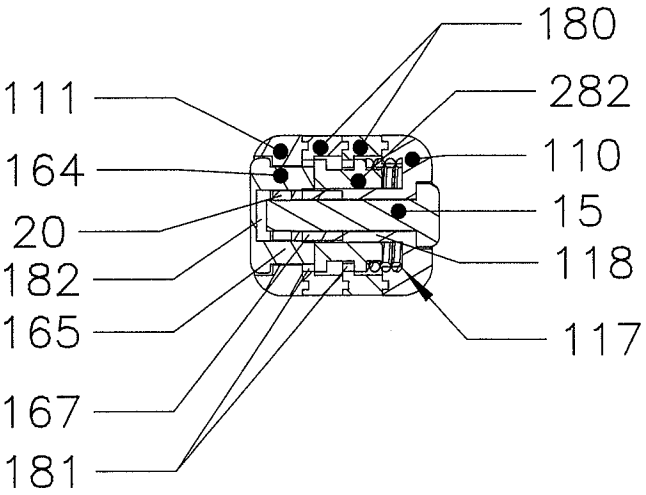
FIG. 29 A sectional view of the positive locking mechanism with two bit holders in a unlocked position.

FIG. 29 is a sectional view of the same positive engagement multiple position locking mechanism as shown in FIG. 28 in its unlocked state. Push button 164 is being forced inward by an operator who applies a force greater than the spring 117 force reducing the displacement space 182 by the stroke length of the push button displacement. The stroke of displacement is less than the width of a single driver or the width of the narrowest driver if more than one driver is being used. The push button stem 165 is transposed through the hole provisions 168 created by the bridge 167 and pushing against and displacing the uniformly spaced spline 120 of the linear lock 169 along the linear slide 118 and away from the uniformly spaced gaps 121 of drivers 180 at the location identified as 181 creating a non-engagement condition between the linear lock 169 and drivers 180. This allows the drivers 180 to be rotated into a desired position. Releasing the force that is applied to the push button 169 allows the spring 117 to expand returning the linear lock 282 along the linear slide 118 and push button 164 to its normal state as shown in FIG. 28 and locking the drivers 180 in their new position.

Figure 30:
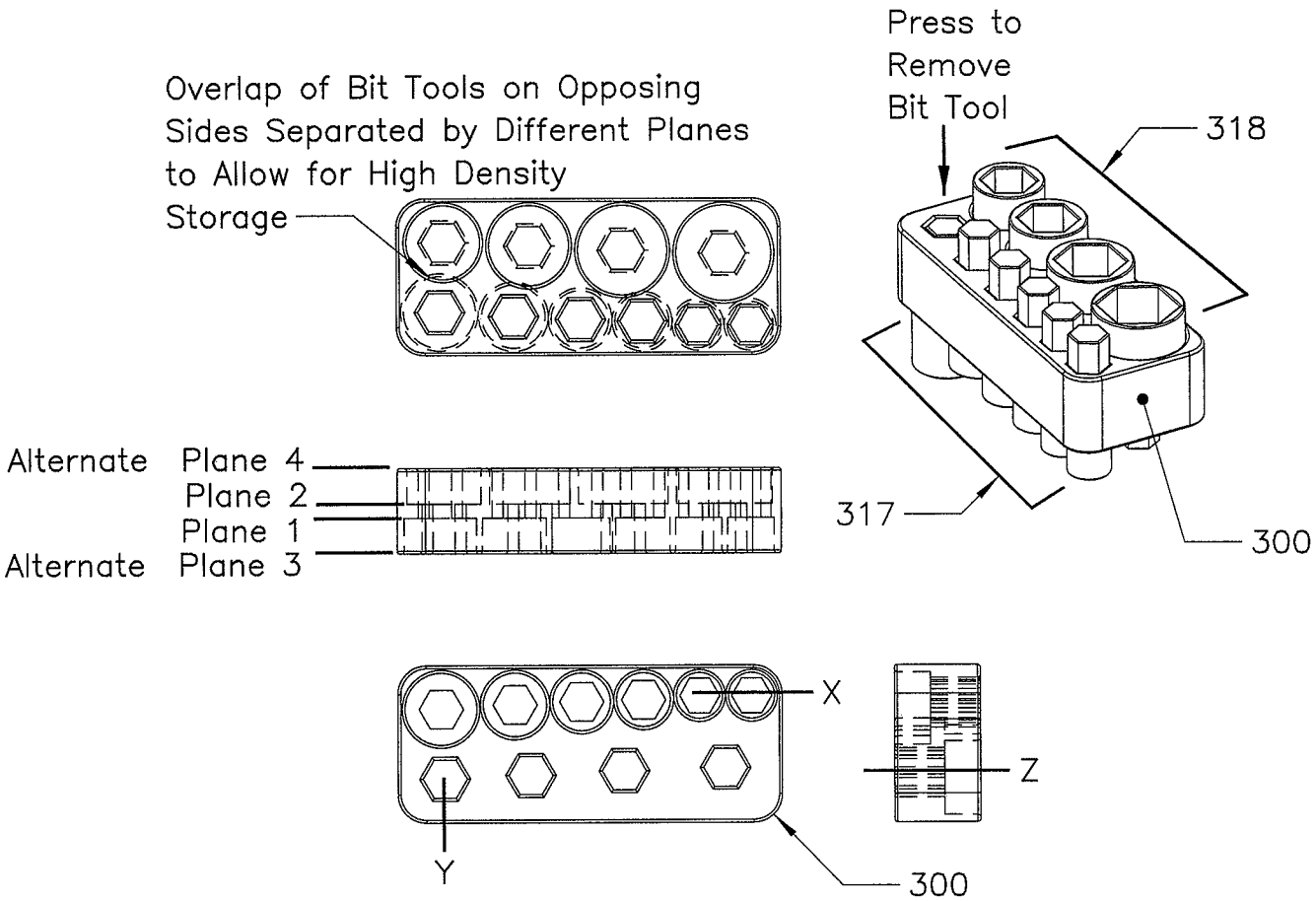
FIG. 30 Multiple views of a non-positional multi-chambered tool bit cartridge that allows for storing tool bits in a cartridge that has a radius to great to rotate.

The multi-chambered tool bit cartridge 300 as shown in FIG. 30 is a non-rotating design. Its features are consistent with the intention of this invention including an X, Y and Z matrix, multiple planes, use of two sides of the tool bit cartridge and that can be stored in an organized fashion within the confines of a standard size tool handle, the combination of the large size and quantity of a full set of socket type tool bits positioned in a multi-chambered tool bit cartridge combined with the turn radius of the subassembly could only be accommodated within a handle that is greater than what would be considered a standard size tool handle is the reason why the design of the multi-chambered tool bit cartridge is a non-rotating design. In a similar fashion to the tool bits shown mounted in either FIG. 18 or FIG. 19 removal is promoted by pushing against the aft end of the tool bit which in turn would slide it forward into an alternate plane in relation to the remaining stored tool bits that maintain their position and allow the tool bit that has been slid to the alternate plane to be gripped and removed from the tool bit cartridge.

Figure 31:
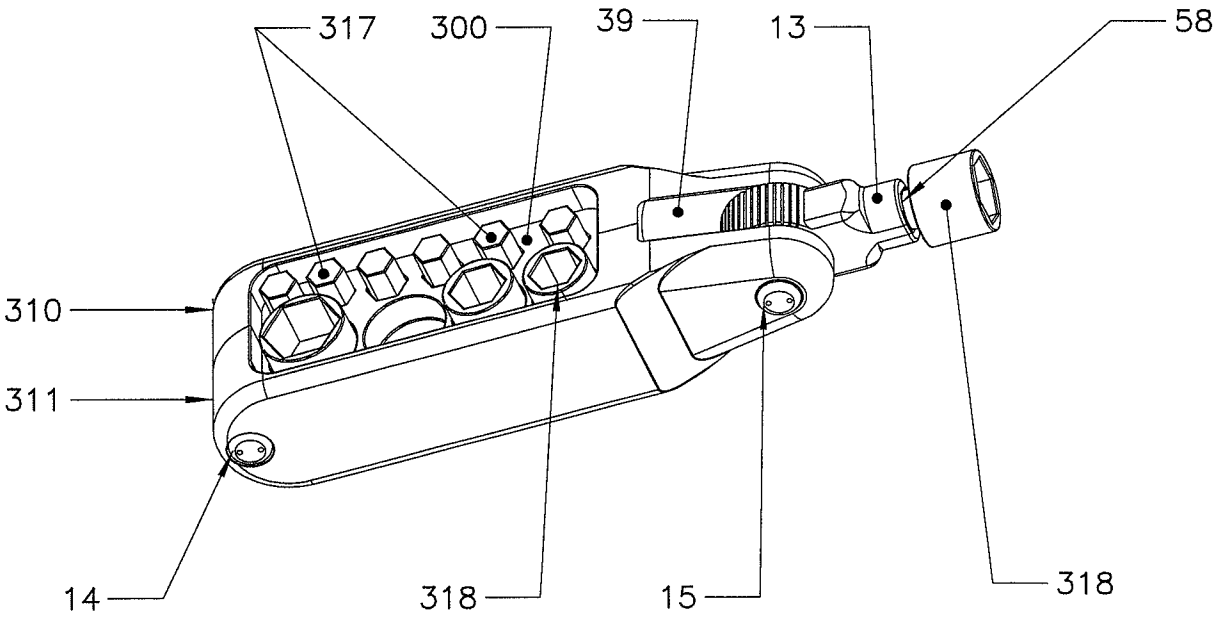
FIG. 31 Depicts a folding toolkit multi-chambered tool bit cartridge as shown in FIG. 30 and tool driver in an extended and open position.

FIG. 31 is an isometric view similar to FIG. 1 of a hand toolkit instrument which embodies a non-positional multi-chambered tool bit cartridge 300 the tool bits and tool bit cartridge do not exceed the dimensions of the open handle and are accessible from two sides for tool bit selection. The positional tool bit driver 13 in an open position for use. The handle sections 310 and 311 are shown to be held together with fastener components 14 and 15 although other means of joining the handle sections such as sonic welding or rivets could be employed. In some instances the handle could be a single component rather than two halves. An assortment of tool bits 317 and 318 are arranged on each side of the multi-chambered tool bit cartridge 300 and fully exposed for selection. A tool bit 318 has been selected and inserted into a mating chamber 58 located in tool bit driver 13 for use.

Figure 32:
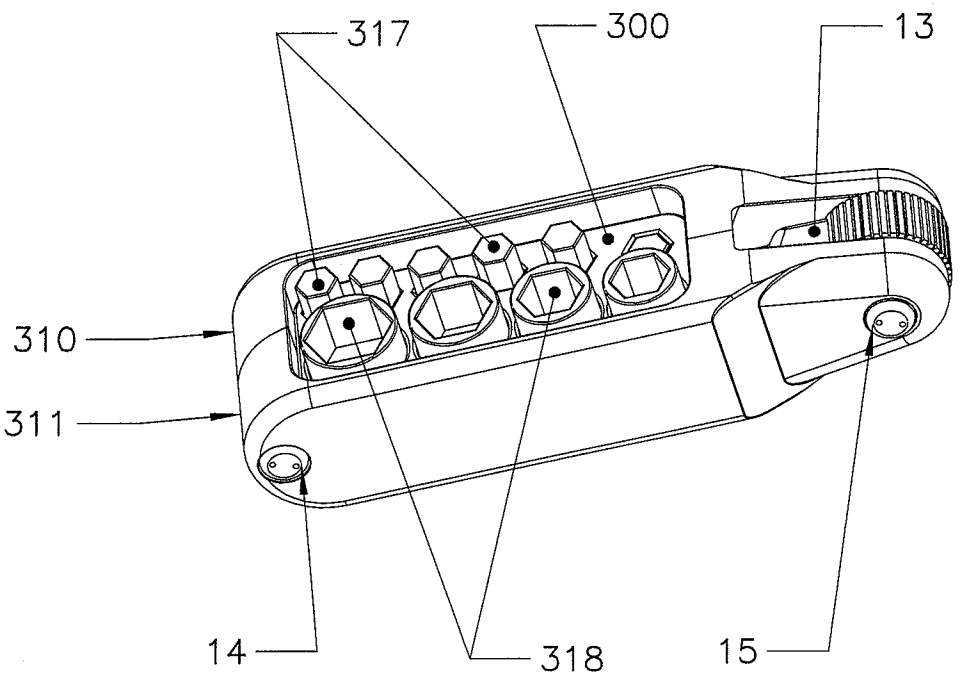
FIG. 32 Depicts a folding toolkit multi-chambered tool bit cartridge as shown in FIG. 30 and tool driver in a retracted and closed position.

FIG. 32 is the same hand toolkit instrument as in FIG. 31, an isometric view which embodies a non-positional multi-chambered tool bit cartridge 300. The tool bit driver 13 in a closed or home position and contained within the handle sections 310 and 311.

Figure 33:
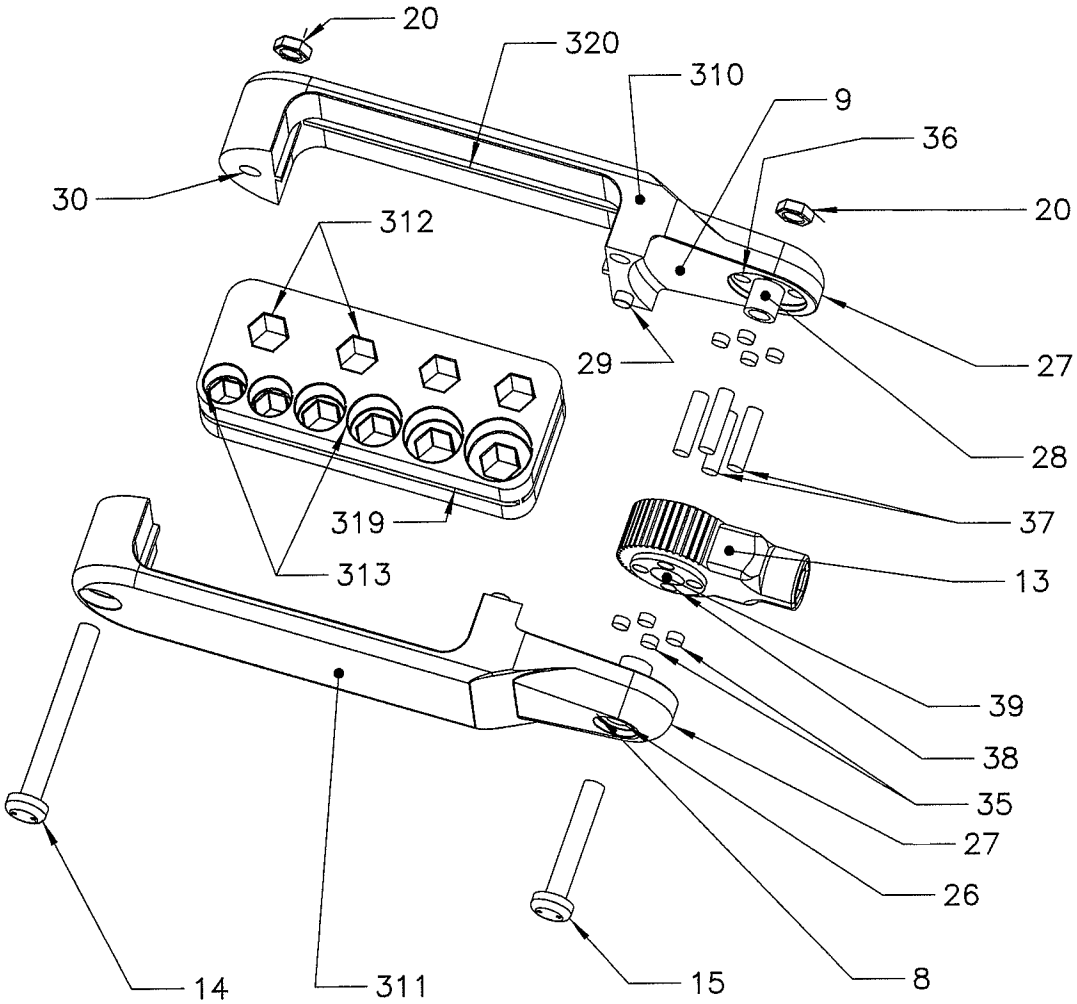
FIG. 33 An exploded view shows this hand tool is equipped with a multi-chambered tool bit cartridge as shown in FIGS. 30 and 31 and bit driver along with a split handle.

FIG. 33 is an exploded isometric view that illustrates assembly and positioning features of the present invention more clearly. The multi-chambered tool bit cartridge 300 is of a non-positional design. Slotted provision 319 located in the side walls of the tool but cartridge is shown to engage with tab provision 320 located in the handle 310 and 311 inside wall sections is an example of securing the tool bit cartridge in place. Similar to FIG. 3 plugs 35 are situated in hole provisions 36 of the inside wall 9 of handle sections 310 and 311 and plugs 37 located in hole provisions 38 of the tool bit driver 13. Additionally, the tool bit driver 13 revolves around axle 28 shown here to be in two sections and attached to handle sections 310 and 311 although other manifestations of axle 28 can produce its primary functions. In this view axle 28 has the functions of being the pivot point 39 for the tool bit driver 13, provide a pathway 26 to connect fastener components 15 and 20 and to perform the function of being a spacer that will prevent handle sections 310 and 311 from being compressed and thus rub against the tool bit driver 13 and restrict free rotation of the tool bit driver. A small clearance gap between the inner walls 9 of handle section 310 and 311 should be maintained to allow free rotation and effective positioning. Stem feature 29 along with the mating hole feature 30 with one or more locations on handle sections 310 and 311 add additional strength to the hand toolkit instrument especially when significant torque is applied to the tool bit driver.

Figure 34:
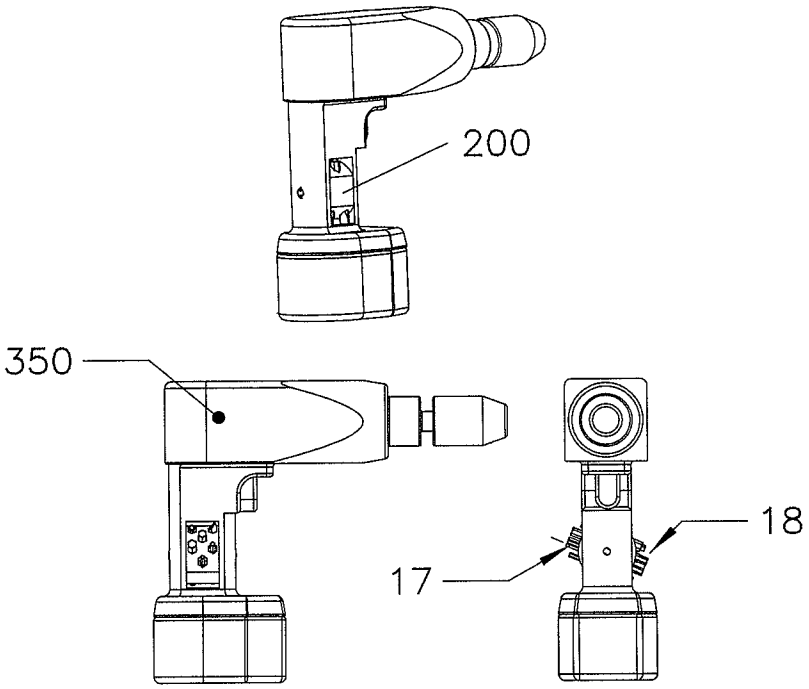
FIG. 34 Depicts a multi-chambered tool bit cartridge located in the handle of a power hand tool and shown in several positions.

Another application of this invention is illustrated in the views shown in FIG. 34 that demonstrates how a multi-chambered tool bit cartridge 200 can be adapted to the handle portion of hand power tool 350. Although a positional multi-chambered tool bit cartridge 200 is shown any manifestation of positional or non-positional multi-chambered tool bit cartridge may apply for this application.

Figure 35:
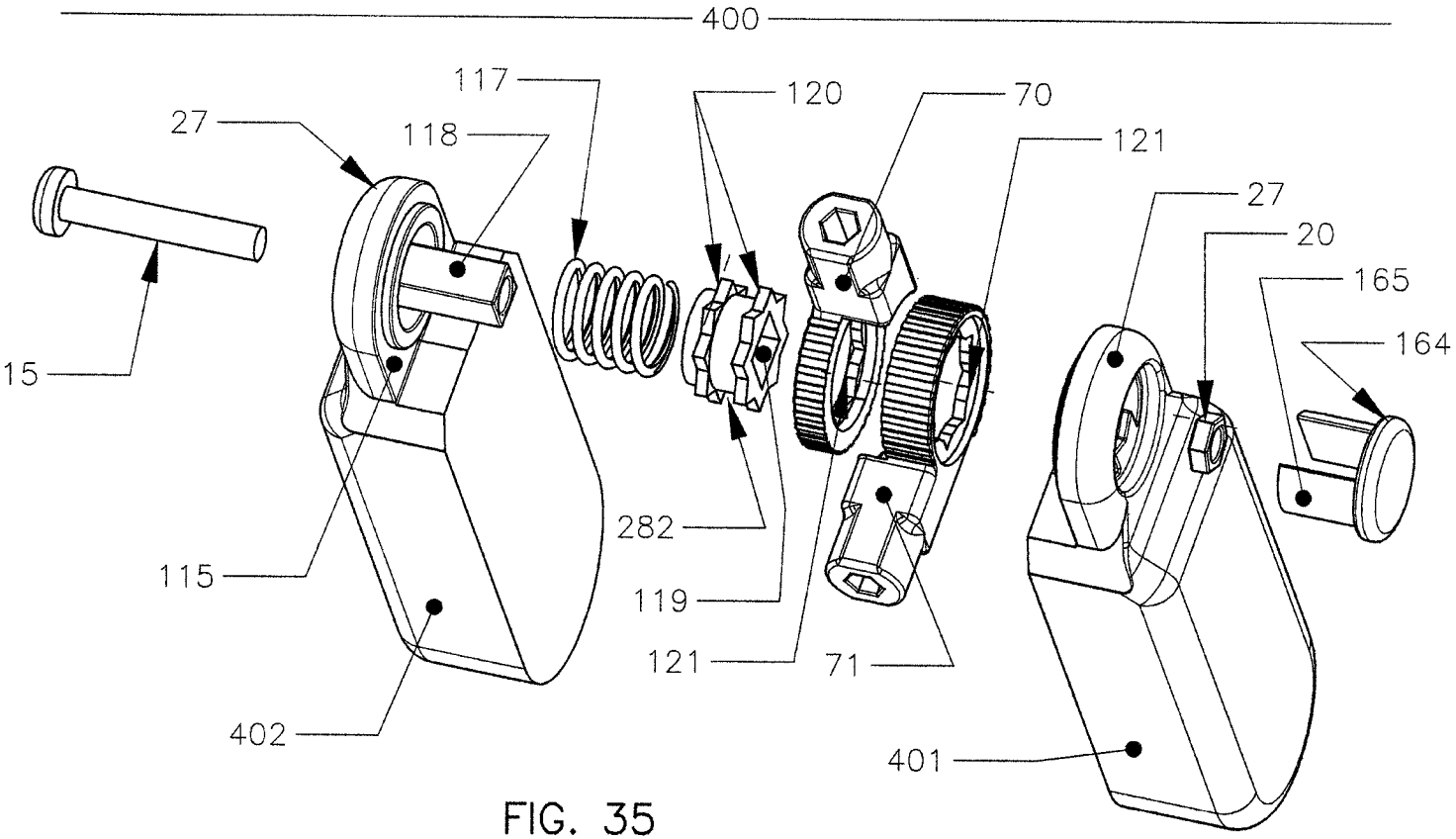
FIG. 35 Depicts an exploded view of an exemplary toolkit with a locking mechanism and split tool device.

FIG. 35 is an exploded isometric view similar to FIG. 27 and illustrates an exemplary assembly 400 including a locking mechanism and split tool device. Although illustrated as being utilized with a toolkit having solid handle sections 401 and 402, it should be understood that the exemplary locking mechanism and/or split tool device can be utilized with the alternative handle sections discussed herein. The solid handle sections 401 and 402 include wing or ear sections 27 which, when the solid handle sections 401 and 402 are assembled relative to each other, create a cavity between inner surfaces 115 for receiving the locking mechanism and/or the split tool device.

The locking mechanism assembly depicted in FIG. 35 is substantially similar to the locking mechanism assembly of FIG. 27. In particular, the locking mechanism assembly generally includes a push button 164 with stem 165, a fastener 15, and a fastener component 20. One of the wing or ear sections 27 includes a linear slide 118 through which the fastener 15 passes. The exemplary locking mechanism assembly generally also includes a bias force device, e.g., a bias compression spring 117, and a linear lock 282. For integration with a split tool device, the linear lock 282 generally includes two sets of uniformly spaced integrating splines 120 and a linear lock core 119. The split tool device, e.g., tool bit drivers 70 and 71, include uniformly spaced gaps 121 at the respective proximal ends configured and dimensioned to mechanically communicate with the uniformly spaced integrating splines 120 to lock and unlock the tool bit drivers 70 and 71 relative to each other and/or the toolkit. In addition, as can be seen from FIG. 35 and as discussed above, a dimensional relationship exists between the proximal end widths and the distal end widths of the tool bit drivers 70 and 71. In particular, the tool bit drivers 70 and 71 are configured and dimensioned to receive dimensionally dissimilar tool bits. The proximal end widths of the respective tool bit drivers 70 and 71 are therefore dimensionally dissimilar in a proportional manner to provide sufficient support for each of the dimensionally dissimilar tool bits. As further seen in FIG. 35, at least one of the proximal end widths of the tool bit drivers 70 and 71 is dimensionally greater than half of the respective distal end width of the tool bit drivers 70 and 71 (tolerances not being considered). As would be understood by those of ordinary skill in the art, when the proximal ends of the tool bit drivers 70 and 71 are positioned in an adjacent relationship, the combined proximal end width does not exceed the larger of the distal end widths of the tool bit drivers 70 and 71. Thus, at least two tool bit drivers 70 and 71 can be placed in an adjacent position relative to each other in a cavity generally dimensioned to receive one tool bit driver 70 or 71. It should further be understood that a substantially similar dimensional relationship exists when extended tools of FIG. 22 are utilized.

While the present invention is thus described with what is considered the most practical and preferred embodiments, it is understood that this invention is not limited to the disclosed embodiments but is intended to cover all various arrangements included within the spirit and scope of the broadest interpretation of this invention.

What is claimed is:

1. A tool device including a cavity defined by side walls located opposite and facing each other, the tool device comprising:

a locking mechanism, the locking mechanism including (i) a linear slide fixed to at least one of the side walls, and (ii) a linear lock configured and dimensioned to at least partially receive and surround the linear slide within a linear lock core, and a tool element, wherein the linear lock includes a row of integrating features and the tool element includes complementary features, the row of integrating features being configured and dimensioned to engage with the complementary features.

2. The tool device of claim 1, wherein the tool element is a tool driver, a tool driver holder, a component holder, a ratchet driver, an extended tool, an extended tool bit stem, or an extended component holder.

3. The tool device of claim 1, wherein the linear slide at least partially spans an inner width defined by the side walls of the cavity, and wherein the linear slide is non-rotatably fixed relative to at least one of the side walls.

4. The tool device of claim 1, wherein a geometry of the linear lock core prevents the linear lock from rotating about the linear slide and allows the linear lock to traverse along a length of the linear slide, and wherein engagement of the row of integrating features with the complementary features fixates the tool element in a non-rotatable position relative to the linear lock.

5. The tool device of claim 1, further comprising a fastener or structural support element extending through or fixed to a first cavity side wall, extending through the linear lock core between the integrating features, and extending through an opposing second cavity side wall, the fastener or structural support element being coupled with a mating fastener or fixed to the opposing second cavity side wall, and the fastener or structural support element coupling the first cavity side wall to the opposing second cavity side wall.

6. The tool device of claim 4, further comprising a spring or bias force positioned between one of the side walls and the linear lock to apply pressure to one of the side walls and the linear lock.

7. The tool device of claim 6, further comprising a push button positioned against or fixed to the linear lock.

8. The tool device of claim 7, wherein the push button or the linear lock protrudes through and engages a hole in one of the side walls of the cavity while the side walls of the cavity maintain a solid structure, and a mating fastener or fixed structural member attached to and providing a pathway for the push button to be positioned against the linear lock.

9. The tool device of claim 7, wherein application of pressure against the push button compresses the spring or bias force and disengages the linear lock from the tool element to allow the tool element to rotate relative to the linear lock, and wherein releasing pressure from the push button expands the spring or bias force and engages the row of integrating features with the complementary features to fixate the tool element in a radial position relative to the linear lock.

10. The tool device of claim 8, further comprising a tool bit cartridge including cartridge gaps complementary to the row of integrating features, the row of integrating features being configured and dimensioned to engage with the cartridge gaps, wherein application of pressure against the push button compresses the spring or bias force and disengages the linear lock from the tool bit cartridge to allow the tool bit cartridge to rotate relative to the linear lock, and wherein releasing pressure from the push button expands the spring or bias force and engages the row of integrating features with the cartridge gaps to fixate the tool bit cartridge in a radial position relative to the linear lock.

11. The tool device of claim 1, wherein the integrating features and the complementary features comprise at least one of splines or gaps.

12. A tool device situated within a holding means, comprising:

a first tool element defining a first proximal end width at a first proximal end and a first distal end width at a first distal end, and a second tool element defining a second proximal end width at a second proximal end and a second distal end width at a second distal end, wherein the first tool element and the second tool element are positioned in an adjacent arrangement, wherein the first proximal end width is dimensioned less than the first distal end width, wherein the second proximal end width is dimensioned less than the second distal end width, and wherein at least one of (i) the first proximal end width is dimensionally greater than half of the first distal end width, or (ii) the second proximal end width is dimensionally greater than half of the second distal end width.

13. The tool device of claim 12, wherein the holding means comprises a cavity defined by side walls located opposite and facing each other, further comprising a shaft fixated to at least one of the side walls of the cavity for alignment of the first tool element and the second tool element.

14. The tool device of claim 12, wherein the first tool element and the second tool element are tools or tool bit drivers, the first distal end width and the second distal end width of the tools being dimensionally dissimilar and the tool bit drivers including a mating chamber at the first distal end and the second distal end configured and dimensioned to receive dimensionally dissimilar tool bits.

15. The tool device of claim 12, wherein a combined proximal end width of the first tool element and the second tool element positioned in the adjacent arrangement does not exceed the greater of the first distal end width and the second distal end width.

16. The tool device of claim 12, further comprising a spacer positioned between the first and second proximal ends of the first and second tool elements in the adjacent arrangement.

17. The tool device of claim 13, further comprising a locking mechanism situated within the cavity, the locking mechanism comprising:

a linear slide fixed to at least one of the side walls, a linear lock configured and dimensioned to at least partially receive and surround the linear slide within a linear lock core, a push button positioned against the linear lock, and a spring or bias force positioned between one of the side walls and the linear lock to apply pressure to one of the side walls and the linear lock.

18. The tool device of claim 17, wherein the linear lock includes a row of integrating features and the first tool element and the second tool element include complementary features, the row of integrating features being configured and dimensioned to engage the complementary features.

19. The tool device of claim 18, wherein application of pressure against the push button compresses the spring or bias force and disengages the linear lock from the first tool element and the second tool element to allow the first tool element and the second tool element to rotate relative to the linear lock, and wherein releasing pressure from the push button expands the spring or bias force and engages the row of integrated features with the complementary features to fixate the first tool element and the second tool element in a radial position relative to the linear lock.

20. A tool device including a cavity defined by side walls located opposite and facing each other, the tool device comprising:

a locking mechanism, the locking mechanism including (i) a linear lock including a linear lock core formed therein, the linear lock being disposed between the side walls, (ii) a push button, and (iii) a fastener, and a tool element, wherein the fastener passes through the linear lock core of the linear lock and an opening of the tool element without impeding with engagement of complementary features of the linear lock and the tool element, wherein the fastener couples the side walls relative to each other, and wherein the fastener, the linear lock, and the push button are positioned in-line relative to each other.

* * * * *